US006389753B1

(12) United States Patent
Fenelon

(10) Patent No.: US 6,389,753 B1
(45) Date of Patent: May 21, 2002

(54) WINDOW LIFT MECHANISM

(76) Inventor: Paul J. Fenelon, 13 Inveraray, Nashville, TN (US) 37215

( * ) Notice: Subject to any disclaimer, the term of this patent is extended or adjusted under 35 U.S.C. 154(b) by 0 days.

(21) Appl. No.: 08/907,731

(22) Filed: Aug. 8, 1997

Related U.S. Application Data

(63) Continuation-in-part of application No. 08/762,447, filed on Dec. 9, 1996, now Pat. No. 6,073,395, which is a continuation-in-part of application No. 08/866,640, filed on May 30, 1997, now Pat. No. 5,806,244.

(51) Int. Cl.[7] ..... E05F 11/38

(52) U.S. Cl. ..... 49/348; 49/349; 185/40 R; 74/89.19

(58) Field of Search ..... 49/362, 374, 375, 49/360, 361, 349, 358, 502, 348; 160/189, 191, 314; 185/40 R; 74/89.17, 89.19; 464/181, 183

(56) References Cited

U.S. PATENT DOCUMENTS

| | | | | | |
|---|---|---|---|---|---|
| 548,695 | A | * | 10/1895 | Capron | 49/348 |
| 1,356,123 | A | * | 10/1920 | Bell et al. | 49/348 |
| 1,487,926 | A | * | 3/1924 | Evans | 49/349 |
| 1,903,358 | A | * | 4/1933 | Nicholson | 49/348 |
| 1,937,662 | A | | 12/1933 | Nicholson | |
| 1,939,159 | A | * | 12/1933 | Atwood | 49/348 |
| 2,293,968 | A | * | 8/1942 | Chandler et al. | 49/349 |
| 2,336,530 | A | * | 12/1943 | Chandler et al. | |
| 2,365,454 | A | * | 12/1944 | Chandler et al. | 49/349 |
| 2,531,116 | A | * | 11/1950 | Donoghue | 49/349 |
| 3,263,367 | A | * | 8/1966 | Tanaka | |
| 3,659,466 | A | | 5/1972 | Pickles | |
| 3,706,163 | A | | 12/1972 | PIckles | |
| 3,706,236 | A | | 12/1972 | Pickles | |

FOREIGN PATENT DOCUMENTS

| | | |
|---|---|---|
| DE | 1931471 | 12/1970 |
| DE | 2217784 | 10/1973 |
| DE | 2544174 | 4/1977 |
| DE | 2841440 | 4/1980 |
| DE | 3243123 | 5/1984 |
| DE | 3545856 | 1/1987 |
| DE | 4005759 | 8/1991 |
| DE | 29613322 | 10/1996 |
| FR | 1425449 | 4/1966 |
| FR | 2111220 | 6/1972 |
| FR | 2550267 | 2/1985 |
| FR | 2650647 | 2/1991 |
| GB | 851436 | 10/1960 |
| JP | 5-86761 | 4/1993 |
| WO | WO 96/41087 | 6/1995 |
| WO | 9737099 | 10/1997 |

(List continued on next page.)

*Primary Examiner*—Curtis A. Cohen
(74) *Attorney, Agent, or Firm*—Harness, Dickey & Pierce, P.L.C.

(57) ABSTRACT

A window lift mechanism for raising and lowering a window in a vehicle door includes a support bracket mounted to the window and a motor supported on the support bracket. A vertical rack is mounted to the door and is positioned immediately adjacent the window, and a vertical guide track is also mounted to the door parallel to the rack and immediately adjacent the window. A pinion gear driven by the motor is supported on the support bracket and engaged with the rack to permit vertical movement of the window. A slide is supported on the support bracket and engaged with the guide track to provide support as the window is raised or lowered. Alternatively, a second rack and pinion are used instead of the guide track and slide. A manual drive mechanism for raising and lowering the window is also disclosed including a drive cable which transfers rotary torque from a drive pulley to a driven pulley supported on the support bracket. The drive cable includes nubs in engagement with recessed dimples in the drive and driven pulleys.

21 Claims, 13 Drawing Sheets

U.S. PATENT DOCUMENTS 3,736,702 A 6/1973 Pickles
3,932,956 A * 1/1976 Young ..... 46/202
4,167,834 A 9/1979 PIckles
4,168,595 A 9/1979 Pickles et al.
4,170,847 A 10/1979 Pickles
4,229,906 A 10/1980 Pickles
4,235,117 A 11/1980 Pickles
4,389,818 A 6/1983 Sakamoto
4,400,913 A 8/1983 Krantz et al.
4,420,906 A 12/1983 Pickles
4,449,326 A * 5/1984 Hori et al. ..... 49/375
4,553,656 A 11/1985 Pickles
4,592,245 A 6/1986 Pickles
4,603,894 A 8/1986 Osenkowski
4,694,610 A * 9/1987 Hornivius ..... 49/351
4,785,585 A 11/1988 Grier et al.
4,850,636 A 7/1989 McLaren et al.
4,905,413 A * 3/1990 Kuki et al. ..... 49/362
4,910,917 A * 3/1990 Brauer ..... 49/348
4,967,510 A 11/1990 Torii et al.
4,986,030 A * 1/1991 Bertolini et al. ..... 49/351
5,005,316 A 4/1991 Hornivius
5,022,184 A 6/1991 Yamamura et al.
5,058,322 A * 10/1991 Sambor ..... 49/348
5,174,066 A 12/1992 Dupuy
5,226,259 A 7/1993 Yamagata et al.
5,243,785 A * 9/1993 Nieboer et al. ..... 49/375
5,251,403 A 10/1993 Compeau et al.
5,307,704 A 5/1994 Müller
5,308,129 A 5/1994 Hlavaty
5,308,138 A 5/1994 Hlavaty
5,351,443 A 10/1994 Kimura et al.
5,355,629 A 10/1994 Kimura et al.
5,367,832 A 11/1994 Compeau et al.
5,410,921 A 5/1995 Deynet et al.
5,425,206 A 6/1995 Compeau et al.
5,439,416 A * 8/1995 Jaskowiak ..... 464/181
5,577,347 A * 11/1996 Heckel et al. ..... 49/349
5,794,478 A * 8/1998 Chen ..... 49/349
5,806,244 A * 9/1998 Tilli ..... 49/362
6,044,589 A * 4/2000 Dallos, Jr. ..... 49/375
6,205,711 B1 * 3/2001 Klippert ..... 49/375

* cited by examiner

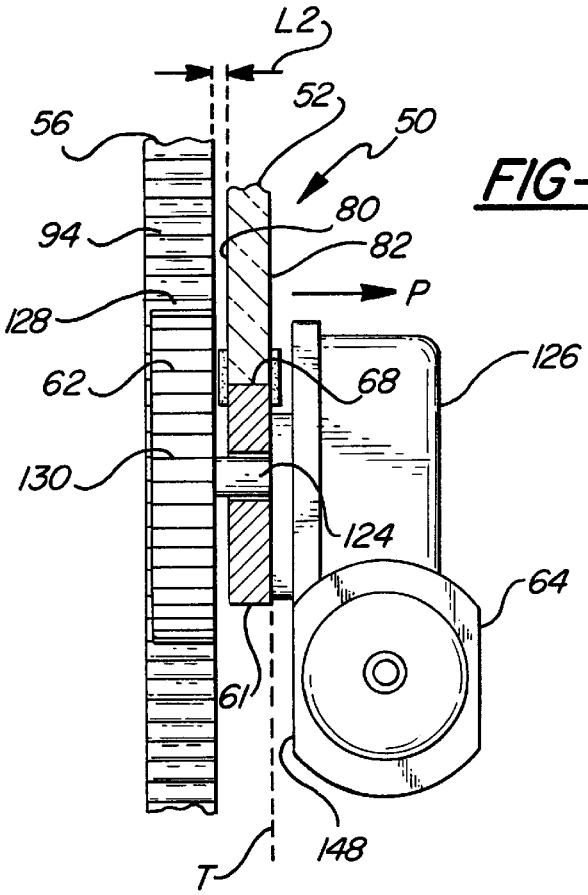
FIG-8
FIG-9
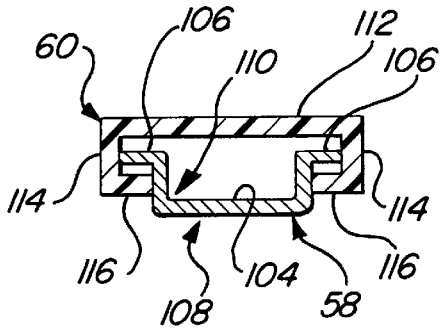
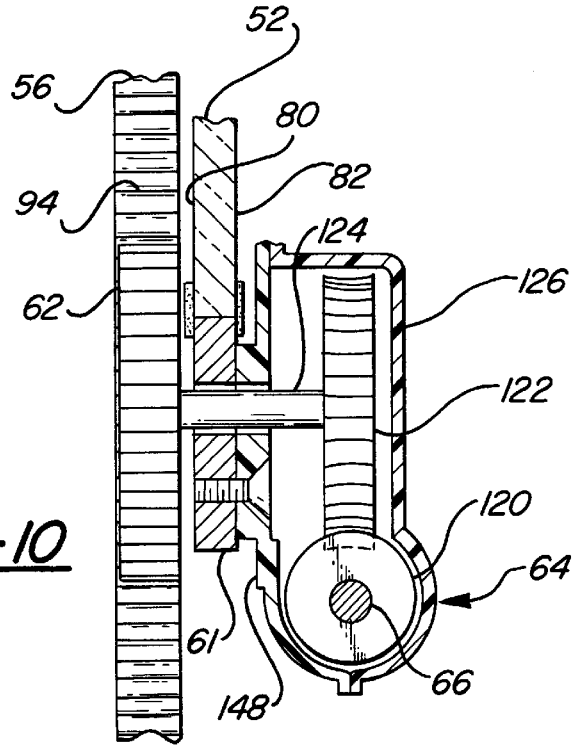
FIG-10

74
76
78
52
70
50
54
164
80
162
162
118
72
68
61
160
86
132
154
153
150
152
88
118
156

74
76
50
78
52
70
54
118
90
136
100
72
94
140
80
138
142
96
116
108
116
68
88
132
61
86
56
62
64
58
92
118
102

186
274
278
172
170
224
268
264
178
286
256
270
288
258
262
186
280
272
276
270
260
266

WINDOW LIFT MECHANISM

This application is a continuation-in-part of U.S. Ser. No. 08/762,447 filed Dec. 9, 1996 now U.S. Pat. No. 6,073,395, and a continuation-in-part of U.S. Ser. No. 08/866,640 filed May 30, 1997, now U.S. Pat. No. 5,806,244.

TECHNICAL FIELD

The subject invention generally relates to an apparatus for moving a closure member, such as a window, into an open or closed position.

BACKGROUND ART

All modern automobiles include a window lift assembly for raising and lowering windows in the door of the vehicle. The most common type of window lift assembly incorporates a "scissor mechanism." As shown in FIG. 1, a scissor-type system includes a door 10, a window 12 vertically moveable within the door 10, a horizontal support bracket 14 on the window 12, and a scissor mechanism 16 supported on the door 10 and engaged with a track 17 on the support bracket 14. A sector rack 18 is supported on the scissor mechanism 16, and a pinion gear 20 supported on the door 10 is engaged with the sector rack 18. In vehicles with power windows, a worm gear 22 driven by a motor 24 is engaged with a driven gear 26 which, in turn, is operatively joined to the pinion gear 20. The motor 24, worm gear 22, and driven gear 26 are all mounted to the door 10 of the vehicle. In vehicles without power windows (not shown), the pinion gear is driven by a manual hand-crank.

Unfortunately, the scissor-type mechanism includes many drawbacks such as the large amount of space and numerous parts required. The scissor-type mechanism is also mechanically inefficient, prohibiting the use of light-weight materials and requiring the use of relatively large motors to drive the system. The large motors necessarily require increased space and electrical power and also increase the weight of the system. With the limited space in a scissor-type system, in order to provide the required torque transfer efficiency it is necessary to have a small diameter pinion gear, typically 0.5 to 0.75 inches, and relatively large driven gear, typically 1.8 to 2.5 inches in diameter, with a gear ratio between the worm gear and driven gear in the 40:1 to 60:1 range. This results in excessive worm gear speed in the range of 3000 to 4000 RPM which causes excessive driven gear tooth shock and armature noise. The combination of high torque, typically 80 to 125 inch-pounds at stall, and shock due to high worm speeds mandates that either expensive multiple gears and/or single driven gears with integral shock absorbers be utilized.

In U.S. Pat. No. 4,167,834 to Pickles, a more mechanically efficient vertical rack and pinion window lift system is disclosed. This type of system is represented in FIGS. 2 and 3 and includes a door 28, a window 30 vertically moveable within the door 28, a support bracket 32 on the window 30, a vertical rack 34 supported on the door 28, and a pinion gear 36 supported on the support bracket 32 in engagement with the rack 34. A motor 38 is supported on the support bracket 32 on the same side of the window 30 as the rack 34 and pinion gear 36 and drives the pinion gear 36 through a worm gear/driven gear transmission (not shown) engaged with the pinion gear 36. The pinion gear 36 is continually meshed with the rack 34 to drive the window 30 up and down. Obvious advantages of this system are the mechanical efficiency, fewer parts and, hence, reduced weight, and reduced motor size. The system is also more simple to install than the scissor-type system.

The Pickles window lift assembly, while theoretically plausible, does not function adequately due to the complex method and arrangement used to adapt the support bracket 32, motor 38, worm gear, and driven gear to the window 30. As discussed in U.S. Pat. No. 4,967,510 to Torii et al., in window lift systems of the type shown in FIGS. 2 and 3 (such as the Pickles system) a larger torque than necessary is required to drive the system due to the angular moment set up by the weight of motor 38 and related structure. In addition, more space than necessary is required due to the "superimposed sequential" stacking of components.

An additional problem with the Pickles system is that a guide member (not shown) is mounted to the support bracket 32 and surrounds the rack 34 to restrict relative movement between the rack 34 and the bracket 32. In addition, the motor 38, associated transmission housing (not shown), and pinion gear 36 are fixedly mounted to the bracket 32 such that the rack 34 and pinion gear 36 are integrally meshed and relative movement is prevented. By preventing any relative movement between the rack 34 and pinion gear 36, the system can bind up or at least provide added resistance to vertical movement, resulting in the need for a larger motor. Binding between a rack and pinion gear is a particular problem given that, as the window is driven upwardly, the window moves in side channels in the door which can place additional torque on the window due to irregularities in the side channels and in the window edges in contact with the side channels. The fact that the window is driven and guided from only a single point on the lower edge of the window further reduces the stability of the window.

The Pickles system also uses a large driven gear and surrounding housing to accommodate an integral, spring based, shock absorbing mechanism (not shown). The large driven gear together with a relatively small pinion mandates that a high motor speed be used, resulting in a noisy operation in order to close the window in a reasonable time frame, such as four seconds.

The system disclosed in the Torii et al. patent improved substantially over Pickles in its functional adaptability. The Torii system is represented in FIG. 4 and includes a window 40, a support bracket 42 on the window 40, a motor 44, a pinion gear 46, and a rack 48. To eliminate the angular moment on the window 40 caused by the weight of the motor 44, the Torii system positioned the motor 44 such that the center of gravity of the motor 44 was substantially aligned with the plane of movement of the window 40. However, as shown in FIG. 4, this arrangement prevents the rack 48 from being positioned as close as possible to the window 40, resulting in an increased angular moment on the window 40 caused by the torque generated at the rack/pinion gear interface acting upon a larger than necessary moment arm L. This angular moment can cause the window to "pull in" in the direction shown by the arrow labeled P.

Although not shown in FIG. 4, the Torii et al. system is similar to the Pickles system by including a guide track integrally joined with the rack and a slide engaged with the guide track and supported on the support bracket. Similar to the Pickles system, this arrangement prevents relative movement between the rack and pinion gear and can cause the system to bind up or provide added resistance to vertical movement. The window is also driven and guided from only a small area on the lower edge of the window which reduces the stability of the window in the same manner as discussed above for the Pickles system.

Therefore, it is desirable to provide a window lift system which includes the benefits of a rack and pinion system while providing smooth operation as the window is raised and lowered and minimizing the torque placed on the window.

SUMMARY OF THE INVENTION AND ADVANTAGES

In one embodiment of the present invention, a closure assembly is provided including a closure member, a motor positioned on a first side of the closure member, a rack positioned on a second side of the closure member and immediately adjacent the closure member, and a pinion gear supported on the closure member and engaged with the rack. By reducing the spacing between the rack and the closure member, this system reduces the moment placed on the closure member caused by the torque at the interface between the rack and pinion gear.

In another embodiment of the present invention, a closure assembly is provided including a closure member, a pinion gear supported by the closure member, a rack engaged with the pinion gear, a guide track non-integral with the rack and spaced from the rack, and a slide supported by the closure member and operatively engaged with the guide track. The guide track and rack are parallel in this embodiment. This system is advantageous by providing a guide track spaced from the rack to increase the stability of the closure member as the closure member is raised and lowered.

In another embodiment of the present invention, a closure assembly is provided including a second rack and second pinion gear in lieu of the guide track and slide of the embodiment discussed above. In this embodiment as well, the two separate racks provide added stability to the closure member as the closure member is raised and lowered.

In another embodiment of the present invention, a closure assembly is provided including a closure member, a pinion gear supported by the closure member, and a flexible rack operatively engaged with the pinion gear. The flexible rack is advantageous by permitting the rack to absorb some of the shock that would otherwise be placed on the rack and pinion when the closure member is stopped after being raised or lowered. The flexible rack also prevents jamming between the rack and pinion gear that might otherwise occur between a rigid rack and a pinion gear.

In another embodiment of the present invention, a closure assembly is provided including a closure member, a first pinion gear supported by the closure member, a first rack operatively engaged with the first pinion gear, a drive pulley, a driven pulley operatively engaged with the first pinion gear, and a drive cable operatively engaged with the drive pulley and the driven pulley whereby the drive cable transfers rotational torque from the drive pulley to the driven pulley. This embodiment combines the benefits of a rack and pinion system with a lightweight and efficient cable and pulley drive mechanism.

BRIEF DESCRIPTION OF THE DRAWINGS

Other advantages of the present invention will be readily appreciated from the following detailed description of the invention when considered in connection with the accompanying drawings wherein:

FIG. 8 is a cross-sectional side view of the first embodiment of the present invention;

FIG. 9 is a sectional view of the guide track of the present invention;

FIG. 10 is a cross-sectional view illustrating the motor assembly shown in FIG. 8;

DETAILED DESCRIPTION OF THE PREFERRED EMBODIMENTS

Figure 6:
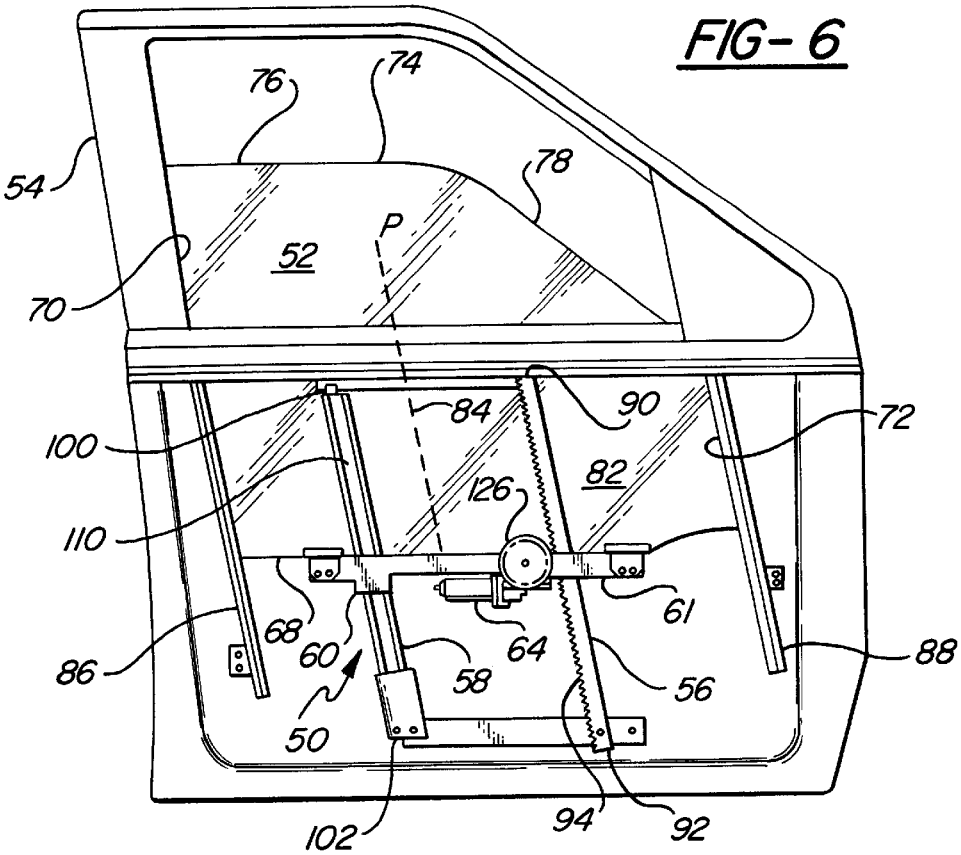
FIG. 6 is a first embodiment of the present invention including a separate guide track and a rack mounted to a vehicle door.
Figure 7:
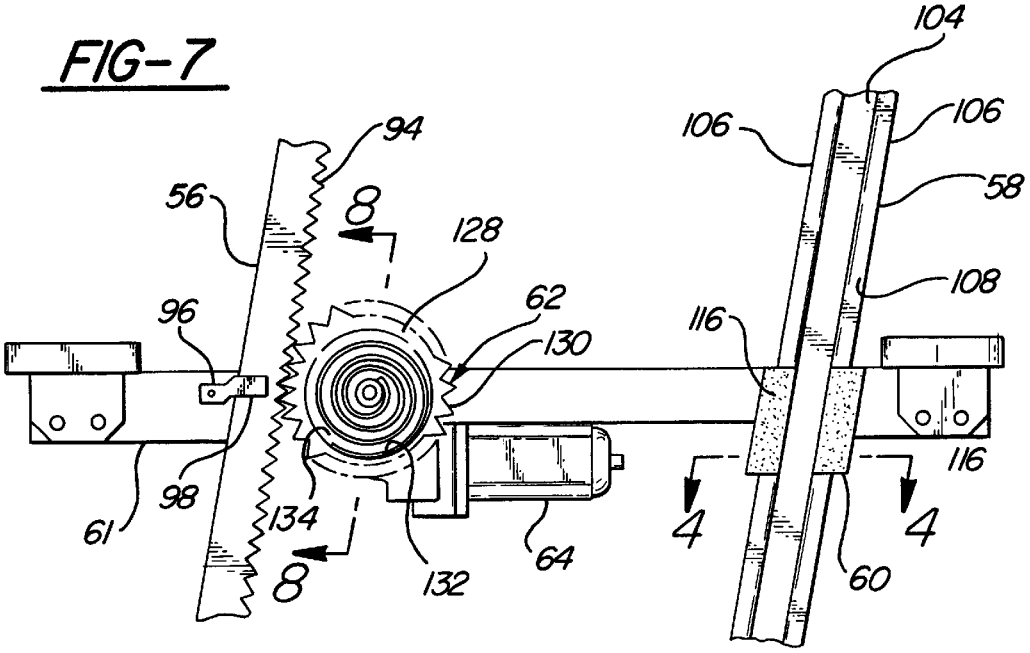
FIG. 7 is a close up view of the first embodiment of the present invention.

A first embodiment of the present invention is shown generally in FIGS. 6 and 7 and comprises a closure assembly 50 for moving a closure member into an open or closed position. The closure assembly 50 includes a closure member 52, such as a vehicle window 52, supported for vertical movement by a support frame 54, such as a vehicle door 54. A rack 56 is supported by the door 54 immediately adjacent the window 52 and extends substantially vertically. A guide track 58 is supported by the door 54 parallel to the rack 56 and spaced therefrom, and a slide 60 is supported by a support bracket 61 on the window 52 and is operatively engaged with the guide track 58. A pinion gear 62 is operatively engaged with the rack 56 and is indirectly supported by the support bracket 61 and located immediately adjacent the window 52. A motor 64 is also supported by the support bracket 61 and includes an output shaft 66 (shown in FIG. 10) operably connected to the pinion gear 62.

The window 52 includes a bottom edge 68, a first side edge 70, a second side edge 72, and a top edge 74. The top edge 74 includes a first segment 76 which is horizontal and a second segment 78 which tapers downwardly at an angle toward the second side edge 72. The bottom edge 68 is also horizontal and is parallel to the first segment 76 of the top edge 74. The first and second side edges 70,72 are parallel to each other but are skewed slightly with respect to the bottom edge 68 of the window 52 and are not perpendicular thereto. More specifically, the first side edge 70 forms an obtuse angle with respect to the bottom edge 68 and the second side edge 72 forms an acute angle with respect to the bottom edge 68. The window 52 is curved from the top edge 74 to the bottom edge 68 and includes a concave inner surface 80 and a convex outer surface 82. The window 52 includes a center of mass 84 with a plane P running through the center of mass 84 and parallel to the side edges 70 and 72 which bisects the window 52 into sections of equal weight.

The door 54 includes first and second guide slots 86,88 for guiding the first and second side edges 70,72 of the window 52, respectively, along a vertical movement path in either an upstroke or a downstroke. The guide slots 86,88 are parallel to the guide track 58, the rack 56, and the side edges 70,72 of the window 52. The structure of the guide slots 86,88 is well known in the art and need not be described in detail herein.

The rack 56 includes a top end 90 and a bottom end 92 which are each bolted to brackets 118 which are, in turn, securely mounted to door 54. As shown best in FIG. 8, the rack 56 is positioned on the concave side 80, or inside 80, of the window 52 and is curved from the top end 90 to the bottom end 92 to match the curvature of the window 52 such that a predetermined distance is maintained between the window 52 and the rack 56. Ideally, the rack 56 is maintained as close as possible to the window 52, preferably one-quarter inch or less from the window 52, for reasons that will be discussed in more detail below. Relative to the bottom edge 68 of the window 52, the rack 56 is facing the guide track 58 and positioned between the plane P and the second side edge 72 of the window 52 approximately 2–5 inches from the plane P.

Referring to FIG. 6, the rack 56 includes a vertical row of horizontal teeth 94 facing toward the first side edge 70 of the window 52 and is made of a flexible construction to permit the rack 56 to bend in a direction toward and away from the side edges 70,72 of the window 52 as well as in a direction perpendicular to the inner surface 80 of the window 52. The rack 56 is also moderately flexible in the lengthwise direction to allow the rack 56 to bend and absorb shock as the window 52 reaches a fully closed or open position. The rack 56 is maintained sufficiently rigid, however, to support the weight of the window 52 and to withstand the torque caused by the interaction between the pinion gear 62 and the rack 56 without buckling. Thus, the rack 56 could also be described as semi-rigid. An entirely rigid rack would require that the shock be totally absorbed by the teeth on the engaged rack and pinion gear requiring a more expensive and durable rack and pinion gear. The preferred material for the rack 56 is a reinforced injection moldable thermoplastic wherein the base resin (polymer) is preferably from a crystalline family like polyamide, polyacetal, or polyester.

To maintain the engagement between the rack 56 and pinion gear 62, a meshing bracket 96 is provided in the form of a simple Z shaped member as shown in the close-up view of FIG. 7. The meshing bracket 96 is mounted to the support bracket 61 and keeps the rack 56 and pinion gear 62 engaged by preventing the rack 56 from moving to the left, with reference to FIG. 7, and pulling away from the pinion gear 62. The meshing bracket 96 also includes a free end 98 supported adjacent the rack 56 which provides an outer boundary for relative movement between the rack 56 and pinion gear 62 caused by the rack 56 moving toward and away from the window 52 in a direction perpendicular to the inner and outer surfaces 80,82 thereof. To minimize friction between the meshing bracket 96 and the rack 56, surface contact should be minimized while lubricity should be maximized. Hence, the meshing bracket 96 should be adjacent the area of contact between the rack 56 and pinion gear 62 while being no wider than the area of contact, approximately the distance of separation of two rack teeth 94. The free end 98 of a Z shaped bracket must be spaced sufficiently from the rack 56 to allow the rack 56 to move in the thickness direction of the door (perpendicular to the inner and outer surfaces 80,82 of the window 52) to permit limited movement between the rack 56 and pinion gear 62. An L-shaped meshing bracket 96 without a free end 98 would also maintain the engagement between the rack 56 and pinion gear 62 but would not limit movement of the rack 56 toward and away from the window 52.

Similar to the rack 56, the guide track 58 as shown in FIGS. 6 and 7 and includes a top end 100 and a bottom end 102 which are each mounted to brackets 118 which are, in turn, securely bolted to the door 54. The guide track 58 is also positioned on the concave side 80, or inside 80, of the window 52 and is curved from the top end 100 to the bottom end 102 to match the curvature of the window 52. The guide track 58 is spaced from the rack 56 by approximately one-fourth the overall window width and is positioned between the plane P and the first side edge 70 of the window 52.

Although not shown in the Figures, the guide track 58 may also be placed between the rack 56 and the second side edge 72 of the window 52. In such an arrangement, however, the orientation of the rack 56 must be reversed such that the teeth 94 face toward the second side edge 72 of the window 52 and toward the guide track 58.

As shown best in FIGS. 7 and 9, the guide track 58 includes a central channel 104 and two flanges 106 on opposite sides of the central channel 104 extending along the length of the track 58. The guide track 58 also includes a front side 108 facing the inner surface 80 of the window 52 and a back side 110. The slide 60 comprises a C-shaped member which surrounds the back side 110 of the guide track 58 and the flanges 106 thereon. More specifically, the slide 60 comprises a back plate 112 adjacent the back side 110 of the guide track 58, two side members 114 joined to the back plate 112, and two inwardly facing arms 116 joined to the side members 114. The flanges 106 on the guide track 58 have a predetermined thickness, and the spacing between the arms 116 and the back plate 112 is greater than the thickness of the flanges 106 to create tolerance in a direction perpendicular to the inner surface 80 of the window 52. However, the side members 114 are spaced such that there is only minimal tolerance between the flanges 106 and the slide 60 in a "side-to-side" direction parallel to the window 52 and perpendicular to the guide track 58.

As shown in FIG. 6, the rack 56 and guide track 58 are joined to mounting brackets 118 which are, in turn, joined to the door 54. The mounting brackets 118 enable the closure assembly 10 to be pre-assembled prior to installation by securing the rack 56 and guide track 58 to the mounting brackets 118 after engaging the slide 60 with the guide track 58 and the rack 56 with the pinion gear 62. In this manner, the closure assembly 10 can be installed by merely joining the mounting brackets 118 to the door 54 and joining the window 52 to the support bracket 61. The window 52 can also be secured to the support bracket 61 prior to installation of the closure assembly 10 within the vehicle door 54.

As shown in the cross-sectional view of FIG. 10, the motor 64 includes an output shaft 66 with a worm gear 120 thereon in engagement with a driven gear 122. The driven gear 122 includes a central shaft 124 extending from the center of the driven gear 122 to the center of the pinion gear 62. The central shaft 124 coincides with the axis of rotation of the driven gear 122 and the pinion gear 62. The central shaft 124 is fixed to both the driven gear 122 and the pinion gear 62 such that the driven gear 122 and pinion gear 62 rotate together in unison at the same rate of rotation. A driven gear housing 126 surrounds the driven gear 122 and the worm gear 120 and is securely joined to the motor 64.

Figure 7A:
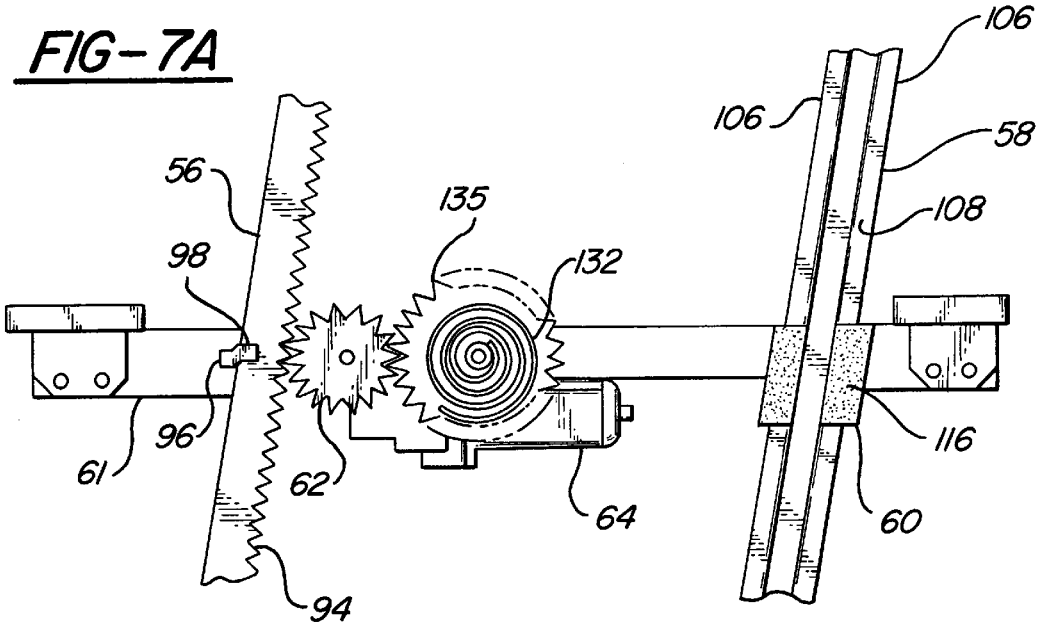
FIG. 7A is a close up view of the first embodiment of the present invention including a supplemental gear with a clock spring engaged with the pinion gear.

The pinion gear 62 includes an outer hub 128 having a plurality of gear teeth 130 positioned along the circumference of the hub 128 as shown in FIG. 7. The preferred material for the pinion gear 62 is a reinforced injection moldable thermoplastic wherein the base resin (polymer) is preferably from a crystalline family like polyamide, polyacetal, or polyester. In the preferred embodiment, the pinion gear 62 includes a clock spring 132 housed within a central cavity 134 in the pinion gear 62. The clock spring 132 provides supplemental torque to the pinion gear 62 during the upstroke of the window 52 to reduce the power output required by the motor 64 and, hence, the required size of the motor 64. The clock spring 132 includes a first end attached to the hub 128 of the pinion gear 62 and a second end attached to the central shaft 124 joining the pinion gear 62 to the driven gear 122. As shown in FIG. 7A, the clock spring 132 can also be mounted in a supplemental gear 135 engaged with the pinion gear 62. This embodiment provides the benefits of utilizing a clock spring 132 while providing more flexibility in selecting the size of the pinion gear 62. More specifically, a smaller pinion gear 62 can be used because the pinion gear 62 no longer contains the clock spring 132. The sizing of the pinion gear 62 is important as it affects various performance characteristics as discussed in detail below.

Figure 12:
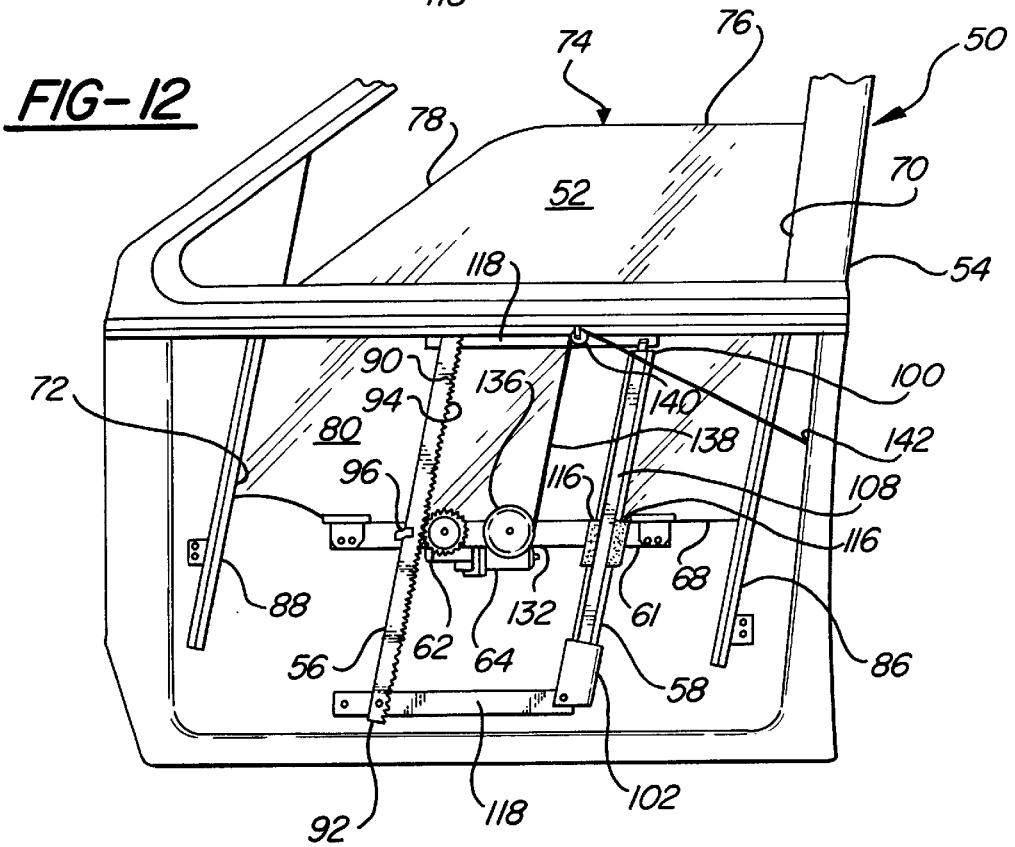
FIG. 12 is a perspective view of the first embodiment of the present invention including a separate clock-spring mechanism.

Alternatively, as shown in FIG. 12 the clock spring 132 can be placed within a separate housing 136 with a first end of the clock spring 132 joined to the housing 136 and a second end joined to a cable 138. The cable 138 extends vertically from the clock spring 132 to a small pulley 140 and then generally horizontally from the pulley 140 to an attachment point 142 on the door 54. The cable 138 is retractable within the housing 136 during the upstroke of the window 52.

As shown best in FIG. 8, the support bracket 61 supports the pinion gear 62 on a first side of a plane tangent to the outer surface 82 of the window 52 at the bottom edge 68 thereof. The plane is designated by the letter T in FIG. 8. More specifically, the pinion gear 62 is supported immediately adjacent the inner surface 80 of the window 52 and the outer hub 128 overlaps the bottom edge 68 of the window 52.

The motor 64 is supported on a second side of the plane T tangent to the window 52 and, more specifically, is supported slightly below the window 52 and includes a center of gravity indicated at 146 located adjacent the outer surface 82 of the window 52. The motor 64 includes an inside edge 148 which is adjacent to the outer surface 82 of the window 52. Preferably, the inside edge 148 is as close as possible to the outer surface 82 of the window 52 without extending beyond the outer surface 82.

The present invention can also be utilized in a closure assembly with a planar window (not shown), such as a sunroof, as opposed to a curved window 52. In this type of assembly, the motor and pinion gear will be positioned in the same relative positions with respect to a planar window as a curved window 52. In other words, the pinion gear will be located immediately adjacent the window on a first side of a plane defined by the window, and the motor will be located on a second side of the plane defined by the window. The guide track and rack will remain positioned immediately adjacent the window but will be straight, as opposed to curved, to match the planar configuration of the window.

Figure 11:
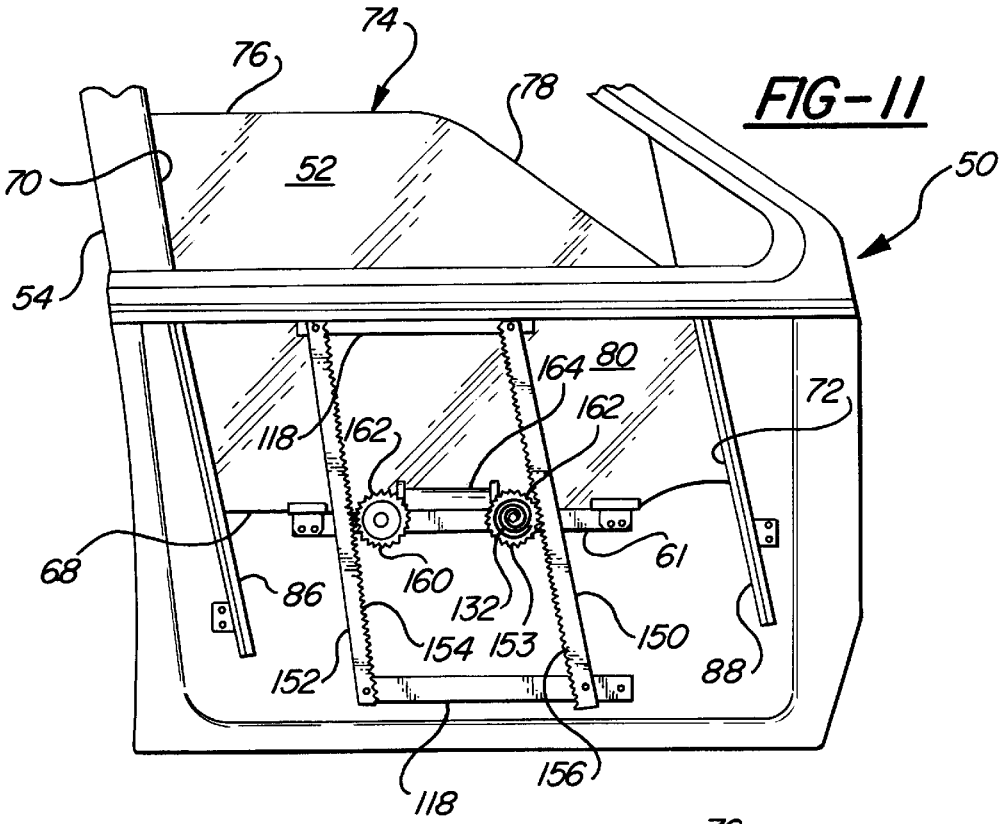
FIG. 11 is a perspective view of a second embodiment of the present invention including two separate racks mounted to a vehicle door.

FIG. 11 illustrates a second embodiment of the invention including first and second racks 150,152 instead of the guide track 58 and rack 56 of the first embodiment. The first rack 150 is identical to the rack 56 in the first embodiment, and the second rack 152 is essentially identical to the first rack 150 and is made from the same material as the first rack 150, includes the same curvature (or lack thereof) as the first rack 150 to correspond to the contour of the window 52, and is parallel to the first rack 150 and positioned immediately adjacent the inner surface 80 of the window 52. The second rack 152 also includes a vertical row of teeth 154 facing toward the second side edge 72 of the window 52 and toward the teeth 156 on the first rack 150. FIG. 11 illustrates the closure assembly 50 on a driver-side door of a vehicle as opposed to a passenger-side door shown in FIGS. 6 and 12.

In the second embodiment, first and second pinion gears 158,160 are supported in spaced locations on the support bracket 61 and include teeth 162 in engagement with the teeth 156,154 on the first and second racks 150,152, respectively. One or both pinion gears 158,160 can also be provided with clock springs 132 as in the first embodiment. In all other material respects, the pinion gears 158,160 of the second embodiment are the same as the pinion gear 62 of the first embodiment.

One of the primary advantages of the second embodiment is that the torque at the interface between the rack and pinion gear is spread out among two separate racks 150,152 and pinion gears 158,160. As such, the materials used for the racks 150,152 and pinion gears 158,160 need not be as strong in the first embodiment with a single rack 56 and pinion gear.

The motor 164 in the second embodiment includes twin output shafts (not shown) having opposite helical angles and extending from opposing sides of the motor 164 each including a worm gear (not shown) in engagement with a driven gear (not shown). Similar to the first embodiment, each driven gear includes a central shaft joining the driven gear to a corresponding pinion gear 158,160.

Figure 13:
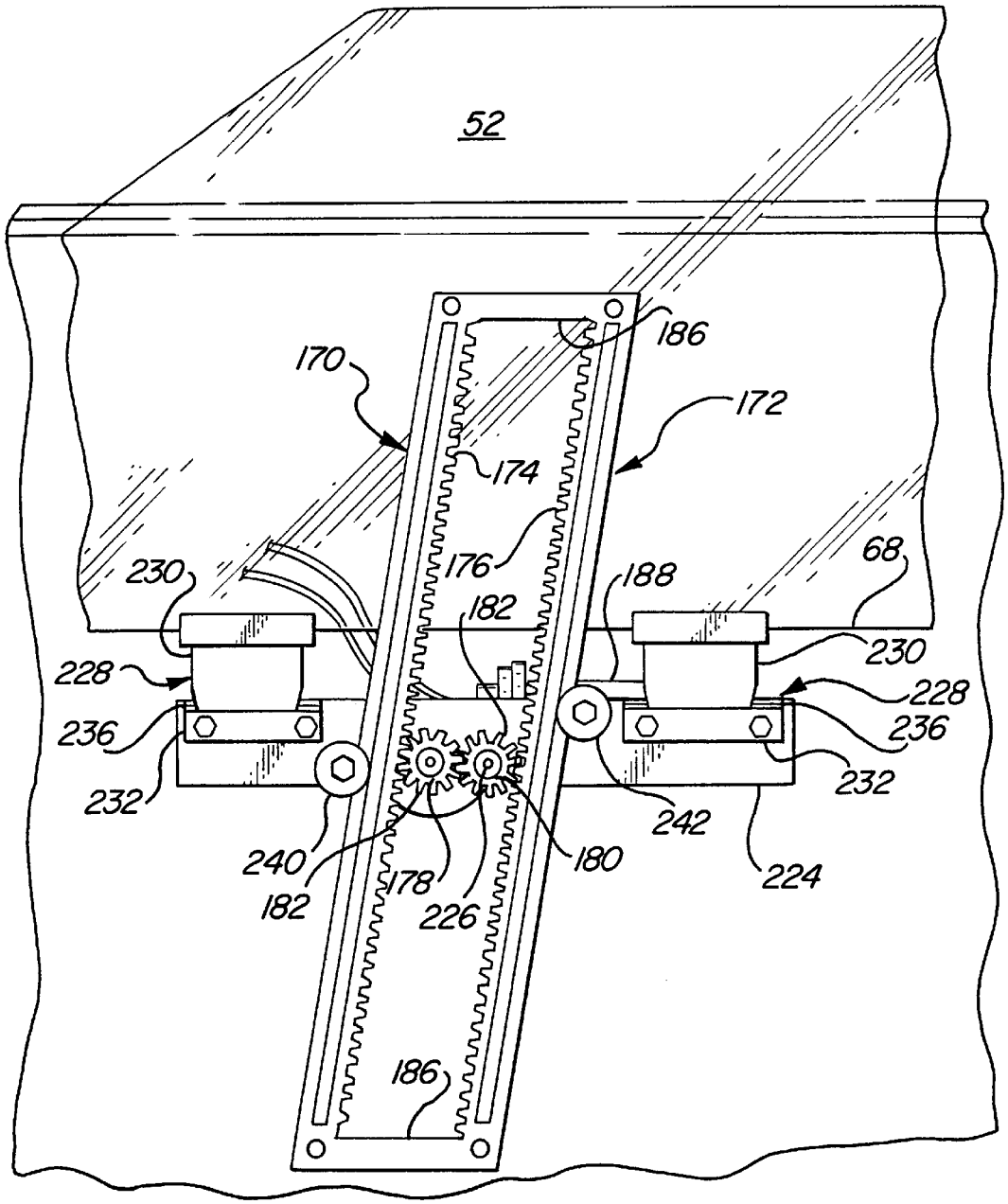
FIG. 13 is a front view of a third embodiment of the present invention.
Figure 14:
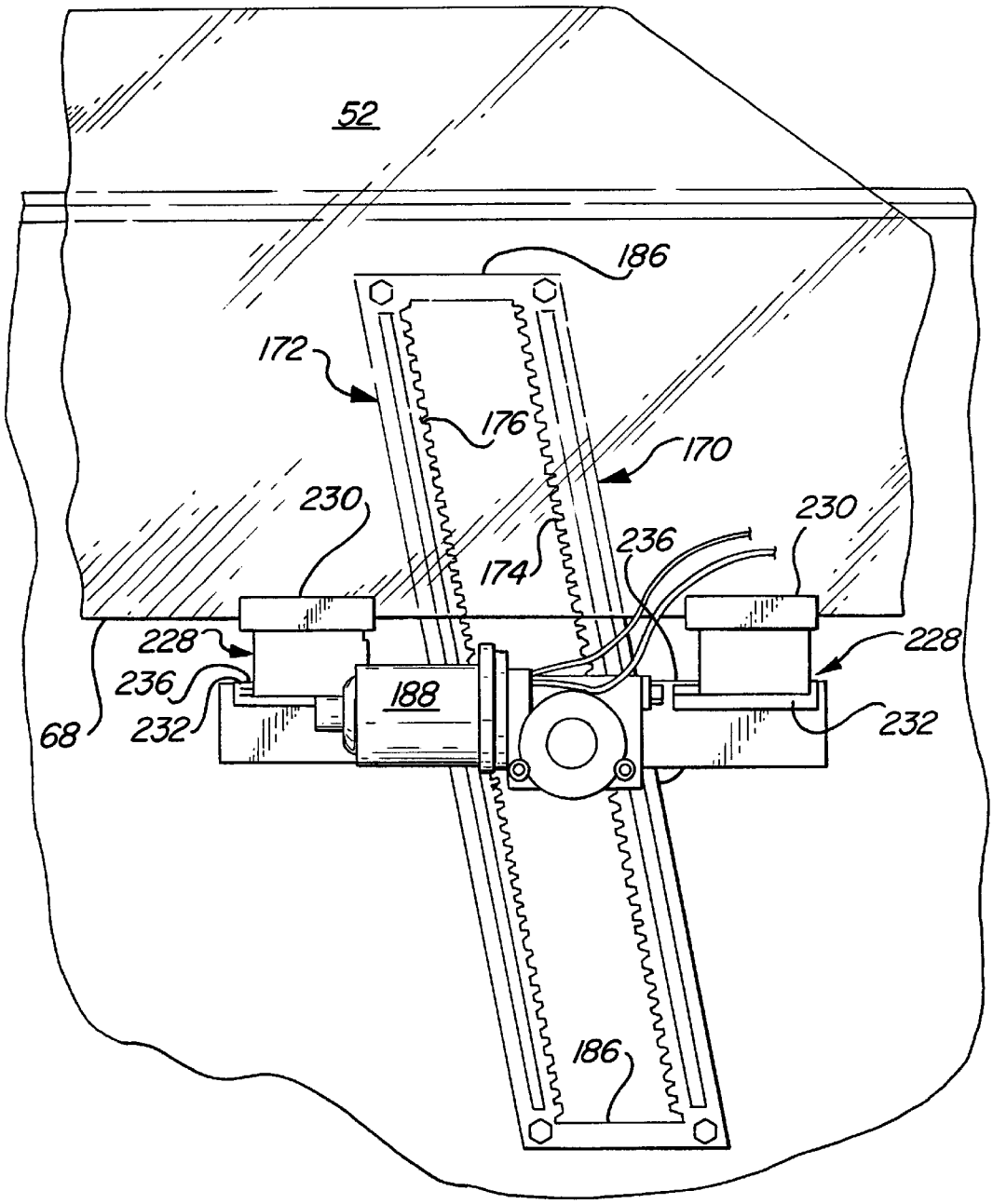
FIG. 14 is a rear view of the third embodiment of the present invention.

The second embodiment of the invention can also be modified as shown in FIGS. 13 and 14 to form a third embodiment of the invention. In the third embodiment, first and second racks 170,172 are provided. The first rack 170 includes a row of teeth 174 which faces toward a row of teeth 176 on the second rack 172. First and second pinions gears 178,180 are also provided which include teeth 182 in engagement with the teeth 174,176 on the first and second racks 170,172. However, the first and second pinion gears 178,180 are also in engagement with one another. Specifically, the first and second racks 170,172 are positioned closely together such that the spacing between the first and second racks 170,172 is the minimum necessary to accommodate the first and second pinion gears 178,180. The racks 170,172 can be spaced approximately 1/10 the width of the window 52, as opposed to approximately 1/4 the width of the window 52 in the second embodiment.

Figure 15:
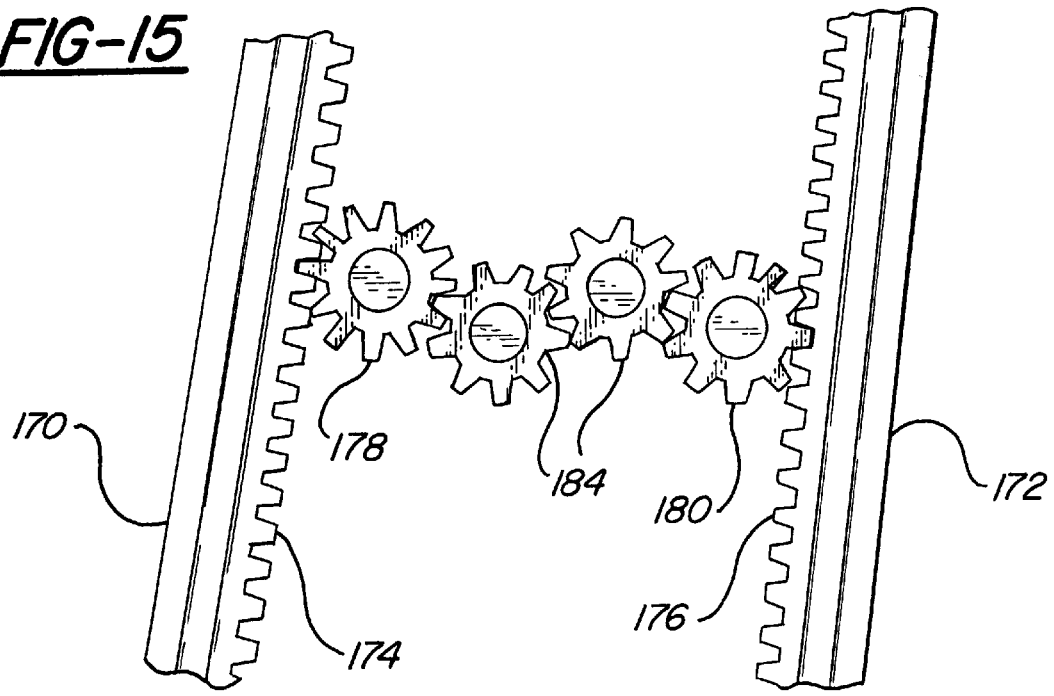
FIG. 15 is a partial front view of the third embodiment of the present invention including spacer gears.

The spacing of the first and second racks 170,172 is ultimately dependent upon the size of the first and second pinion gears 178,180. However, if it is desirable to space the racks 170,172 farther apart it may be impractical and/or detrimental to resize the pinion gears 178,180, particularly when the pinion gears 178,180 have been selected to yield an optimal gear ratio. To solve this problem, spacer gears 184 may be included and disposed between the first and second pinion gears 178,180 as shown in FIG. 15. As long as an even number of spacer gears 184 is provided, rotation of the first pinion gear 178 will produce the same direction of rotation of the second pinion gear 180 as would otherwise occur without the spacer gears 184. Although not shown in FIG. 15, the spacer gears 184 can be placed linearly between the first and second pinion gears 178,180 or, as shown in FIG. 15, can be placed in an offsetting arrangement. The spacing of the first and second racks 170,172 can be adjusted by altering the degree to which the spacer gears 184 are offset, with the linear arrangement providing the maximum spacing for the particular pinion gears 178,180 and spacer gears 184 utilized.

The first and second racks 170,172 are joined by cross members 186 in similar fashion to the mounting brackets 118 shown in FIG. 11. However, the first rack 170, second rack 172, and cross members 186 are molded as a single piece to form an integral, unitary member. This unitary construction simplifies both the manufacture and assembly of the first and second racks 170,172 by eliminating separate mounting brackets 118 which must be separately manufactured and then attached to the first and second racks 170,172 in a subsequent operation. The unitary construction also ensures that the teeth 174,176 on the first and second racks 170,172 are automatically aligned with respect to one another.

Figure 16:
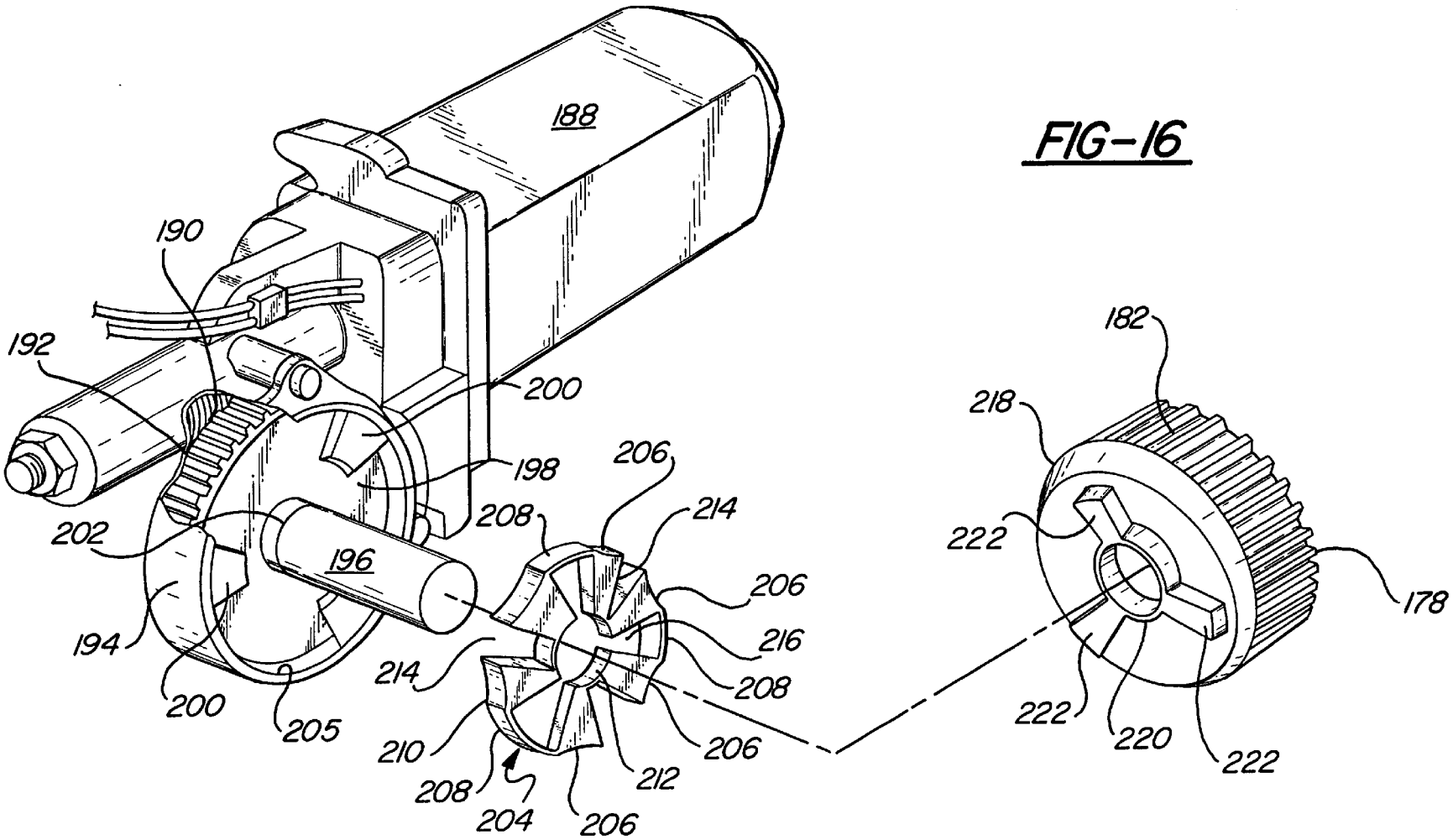
FIG. 16 is an exploded view of the motor, resilient shock absorber, and first pinion gear of the third embodiment of the invention.

The third embodiment includes a motor 188 which, as shown in FIG. 16, includes only a single output shaft (not shown) which drives a single worm gear 190. The motor 188 includes a plastic driven gear 192 in engagement with the worm gear 190, and a housing 194 surrounds the worm gear 190 and the driven gear 192.

The driven gear 192 is supported for rotation by a plastic shaft 196 extending outwardly from the housing 194 and is engaged with the first pinion gear 178 to drive the first pinion gear 178 for rotation. The second pinion gear 180 is not driven by the motor 188, but is, instead, driven by the first pinion gear 178.

The driven gear 192 includes a recessed circular cavity 198 having three tabs 200 which extend radially inwardly within the cavity 198. A cylindrical bore is also disposed in the center of the recessed cavity 198 for receiving the cylindrical shaft 196 and a raised lip 202 surrounds the cylindrical bore. A resilient, compressible shock absorber 204 is disposed within the circular cavity 198 and is made from an elastomeric material such as Santoprene® 55. The resilient shock absorber 204 comprises a continuous, generally circular member including six generally trapezoidal segments 206 joined together by six webs 208. The segments 206 each include an inwardly curved base surface 210 and a top surface 212, and the webs 208 alternate between joining the base surfaces 210 and joining the top surfaces 212 of adjacent segments 206. Thus, the resilient shock absorber 204 defines three outwardly facing recesses 214 adapted to receive the three tabs 200 on the driven gear. The resilient shock absorber 200 also defines three inwardly facing recesses 216.

As illustrated in FIG. 16, the first pinion gear 178 includes a base plate 218 integrally molded therewith having an outer diameter substantially equal to the diameter of the cavity 198 to permit the base plate 218 to be snugly received within the cavity 198. The first pinion gear 178 includes a cylindrical bore for receiving the cylindrical shaft 196, and a raised lip 220 surrounds the cylindrical bore on the base plate 218 and is adapted to receive the raised lip 202 extending upwardly from the cavity 198 in the driven gear 192. Three tabs 222 extend radially outwardly from the raised lip 220 on the base plate 218 and are received within the three inwardly facing recesses 214 of the resilient shock absorber 204.

When the first pinion gear 178 is joined with the driven gear 192, the tabs 200 on the driven gear 192 are disposed between the tabs 222 on the first pinion gear 178 and the segments 206 of the resilient shock absorber 204 are disposed therebetween. As the driven gear 192 rotates, the tabs 200 on the driven gear 192 will rotate into engagement with the shock absorber 204 which will, in turn, engage the tabs 222 on the first pinion gear 178. The shock absorber 204 will reduce the shock between the tabs 200,222 that would otherwise be present with direct engagement of the tabs 200,222. When the shock absorber 204 reaches its maximum compressibility, the inward curvature of the base surfaces 210 of the segments 206 permit the shock absorber 204 to further dampen the forces between the tabs 200,220. Specifically, the curved base surface 210 of each segment 206 will have space to expand outwardly and further absorb shock when the maximum compressibility of the shock absorber 204 is reached.

With the third embodiment shown in FIGS. 13 and 14, the benefits of the dual rack and pinion arrangement can be maintained without requiring the complex dual-output-shaft motor 164 illustrated in FIG. 11. Further, the use of a plastic shaft 196 for supporting the driven gear 192 and the first pinion gear 178, as opposed to a standard metal shaft, significantly reduces the weight of the motor 188.

The first pinion gear 178, the second pinion gear 180, or both can also include a clock spring (not shown in FIGS. 13–16) similar to the clock spring 132 shown in FIG. 7. The clock spring provides supplemental torque to the first pinion gear 178 and/or second pinion gear 180 during the upstroke of the window 52 to reduce the power output required by the motor 188 and, hence, the required size of the motor 188.

As shown in FIGS. 13 and 14, a plastic support bracket 224 supports the motor 188 and window 52 in similar fashion to the support bracket 61 of the first and second embodiments. The support bracket 224 includes an axle 226 extending outwardly therefrom which supports the second pinion gear 160 for rotation. The axle 226 is also made of plastic and is integrally formed with the support bracket 224. The support bracket 224 includes either an opening (not shown) or a cut-out region (not shown) through which the shaft 196 (shown in FIG. 16) and first pinion gear 178 extend.

Two mounting feet 228 join the window 52 to the support bracket 224 and permit the window 52 to move laterally with respect to the support bracket 224.

Figure 17:
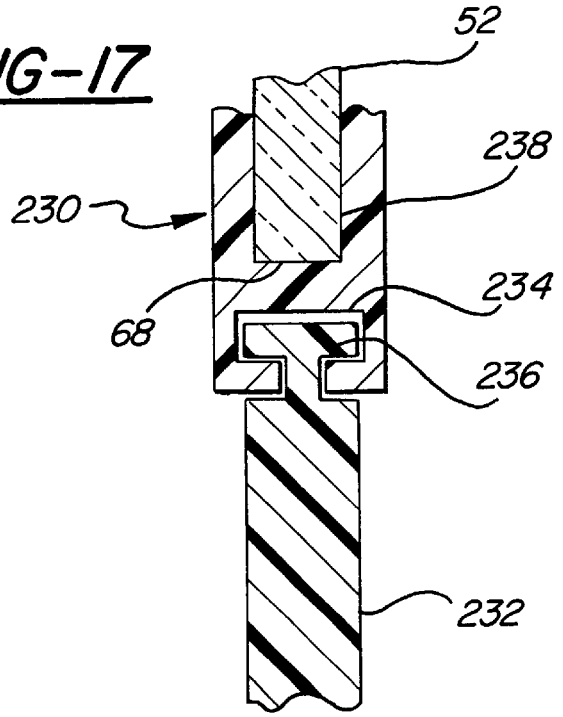
FIG. 17 is an enlarged cross-sectional view of a mounting foot for the window in the third embodiment of the invention.

The mounting feet 228 each comprise a bracket 230 joined to the lower edge 68 of the window 52 and a base member 232 joined to the support bracket 224. As shown in the cross-sectional view of FIG. 17, the bracket 230 includes a lower C-shaped channel 234 which surrounds a flange 236 on the base member 232. The mounting foot 228 also includes an upper U-shaped channel 238 which surrounds the lower edge 68 of the window 52. As shown in FIGS. 13 and 14, the flange 236 is longer than the bracket 230 such that the bracket 230 is capable of slidable lateral movement relative to the base member 232 and the support bracket 224.

As illustrated in FIG. 13, a first guide member 240 is supported by the support bracket 224 and disposed immediately adjacent the first rack 170 on an opposing side of the first rack 170 from the first pinion gear 178. Similarly, a second guide member 242 is supported by the support bracket 224 and disposed immediately adjacent the second rack 172 on opposing side of the second rack 172 from the second pinion gear 180. The guide members 240,242 keep the first and second racks 170,172 in engagement with the first and second pinion gears 178,180. The relative positions of the guide members 240,242 are vertically offset to minimize side-to-side and up and down movement of the support bracket 224 hence window panel. The first guide member 240 is positioned adjacent the point of engagement between the first rack 170 and first pinion gear 178.

Figure 18:
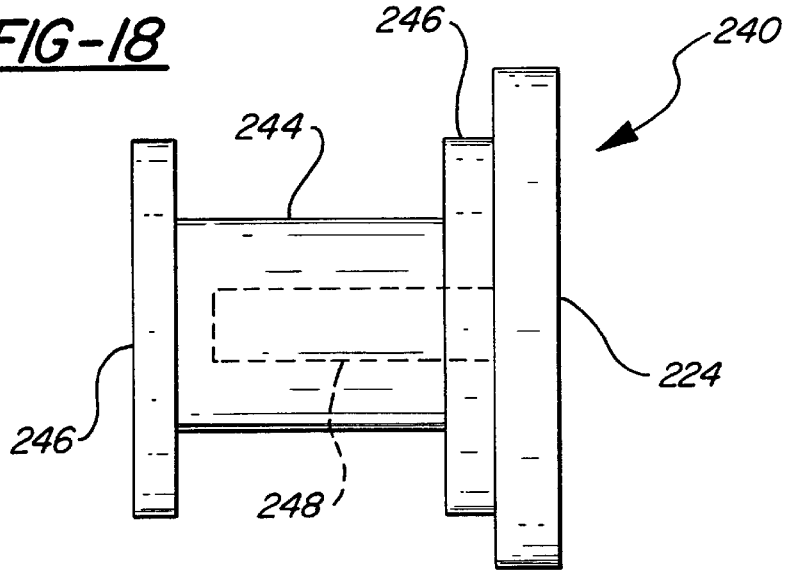
FIG. 18 is a side view of a guide member of the third embodiment of the invention.

As shown in FIG. 18, each guide member 240,242 is a spool-shaped, plastic member and includes a cylindrical body 244 extending perpendicular from the support bracket 224 and a pair of circular flanges 246 extending outwardly from the body 244 at spaced apart locations. The flanges are positioned on opposing sides of the racks 170,172 to restrict movement of the rack 170,172 in the plane of the support bracket 224 toward and away from the support bracket 224. The guide members are rotatably supported by cylindrical posts 248 extending perpendicularly from the support bracket 224. The posts 248 are also made of plastic and are integrally formed with the support bracket 224.

Figure 19:
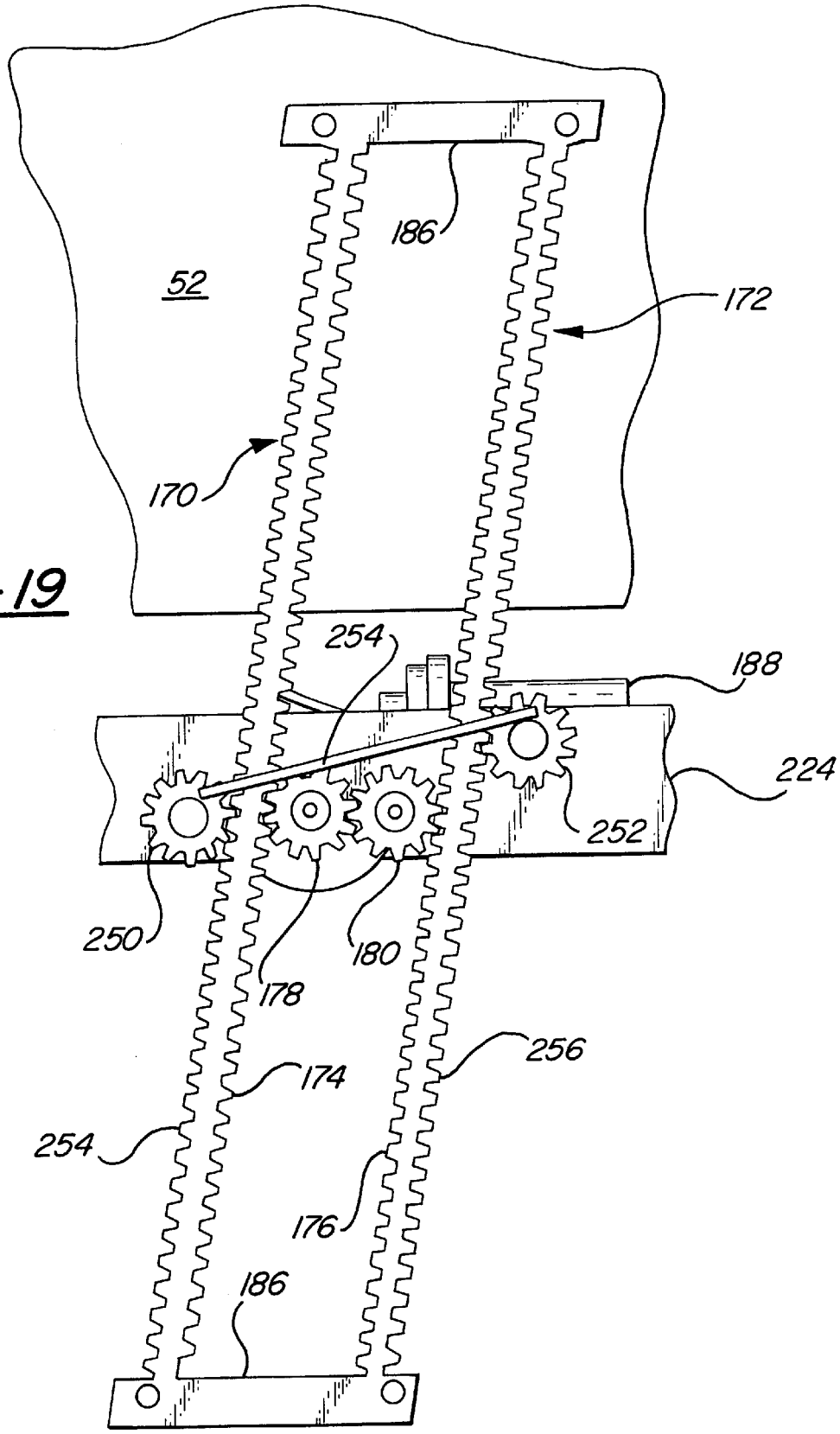
FIG. 19 is a partial side view of the third embodiment of the invention including an alternative guide member.

As shown in FIG. 19, the guide members 240,242 could alternatively comprise gears 250,252 in engagement with additional teeth 254,256 on the first and second racks 170,172 opposite the teeth 174,176, respectively. To reduce lateral movement of the window 52, the guide member gears 250,252 are operatively connected by a brace 254 joined to each guide member gear 250,252 adjacent an outer peripheral edge thereof. The brace 254 moves in a generally circular pattern as the guide member gears 250,252 rotate in unison.

A fourth embodiment of the invention includes a single rack without a guide track 58 or a second rack 152. The fourth embodiment is otherwise identical to the first embodiment shown in FIG. 6, including the position of the rack approximately 2–5 inches from the center of gravity 84 of the window 52 between the center of gravity 84 and the second side edge 72 of the window 52.

Figure 20:
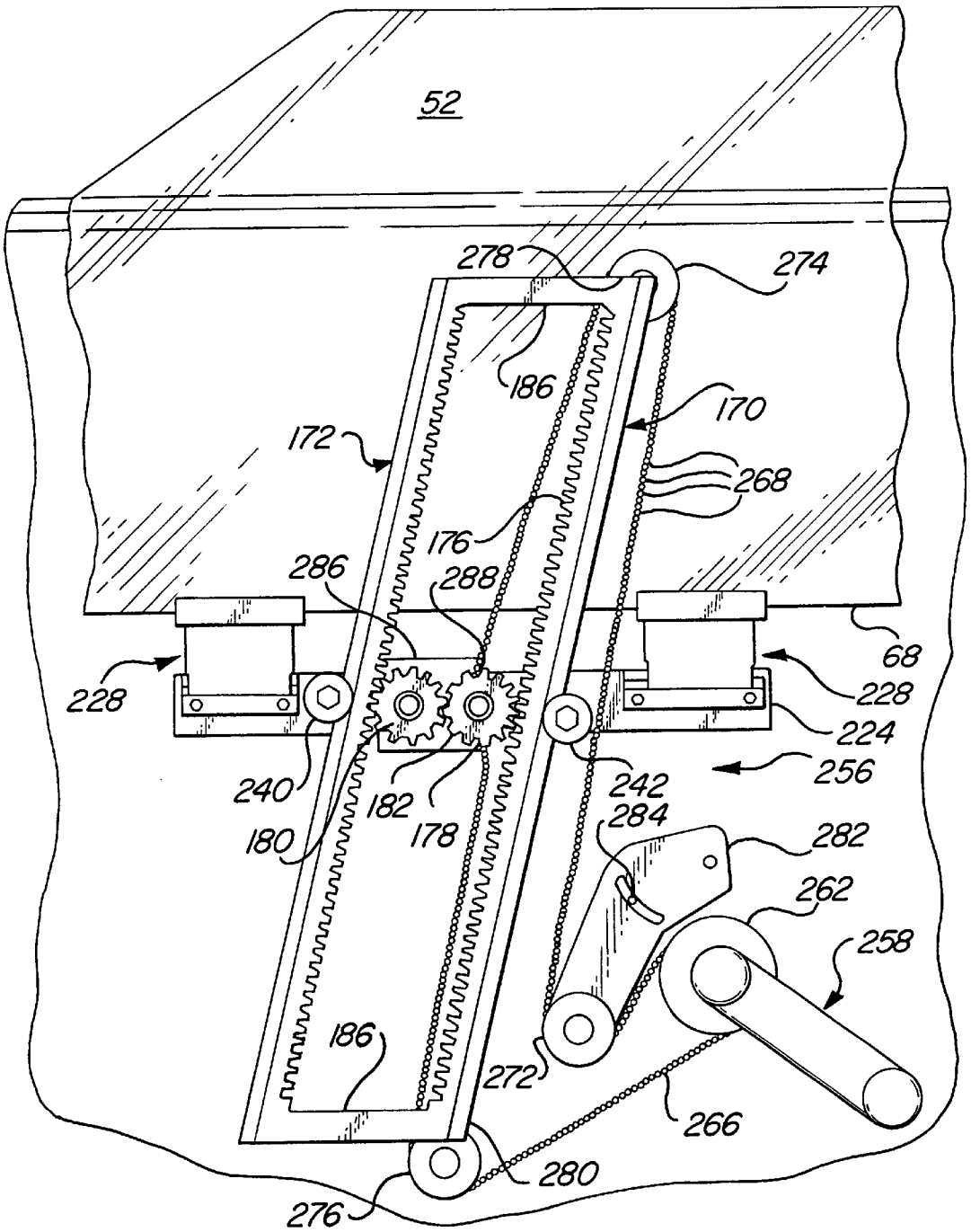
FIG. 20 is a front view of a fifth embodiment of the present invention.
Figure 21:
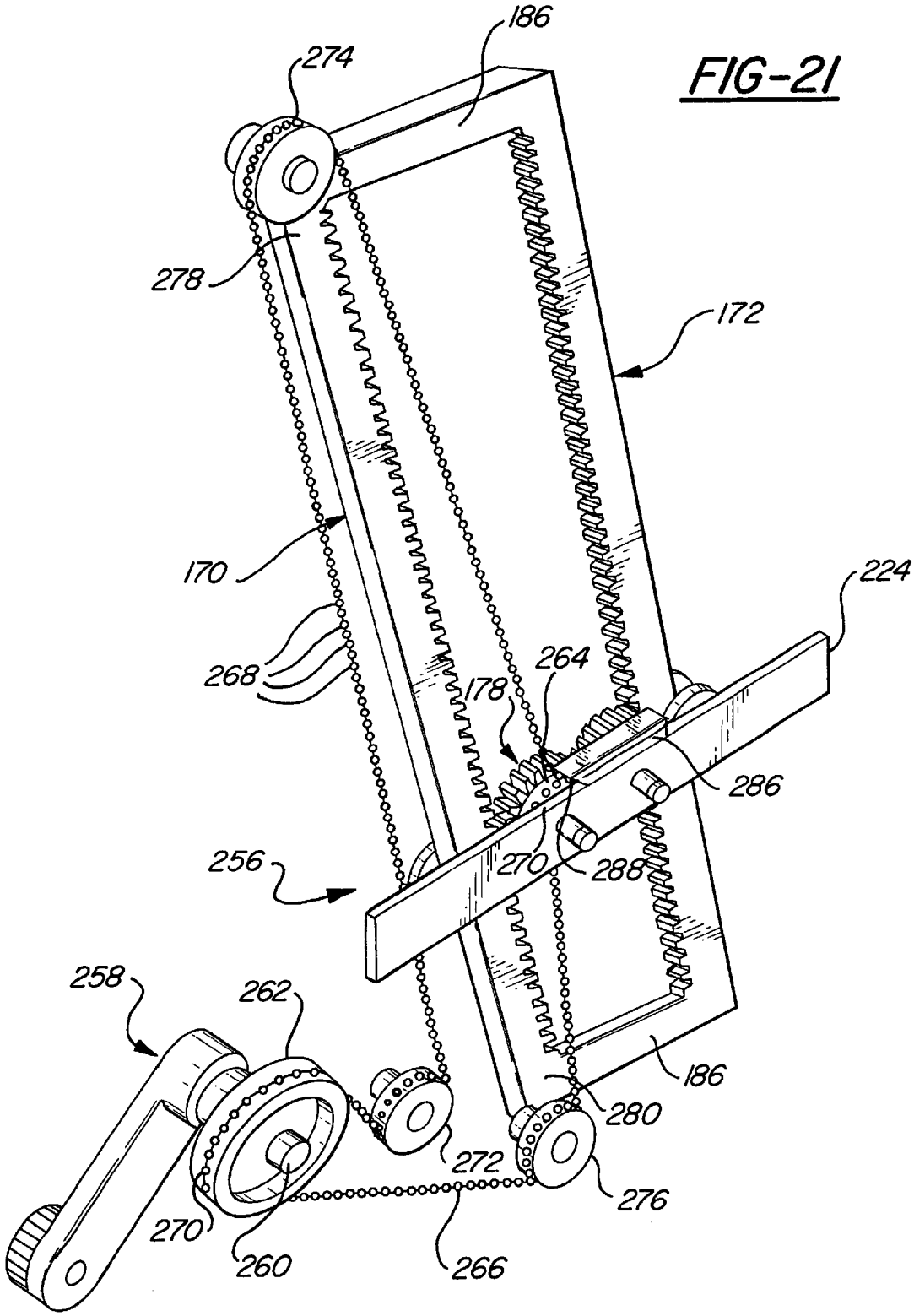
FIG. 21 is a rear perspective view of the fifth embodiment of the present invention.

A fifth embodiment of the invention is shown in FIGS. 20 and 21 and includes a manual drive mechanism 256 for a dual-rack-and-pinion system of the type illustrated in FIGS. 13 and 14. Specifically, the fifth embodiment includes first and second racks 170,172, first and second pinion gears 178,180, a support bracket 224, and guide members 240,242 as described above with respect to FIGS. 13 and 14. The first and second pinion gears 178,180 are in engagement with one another, but the first pinion gear is driven by the manual drive mechanism 256 as opposed to the motor 188 illustrated in FIG. 14.

The manual drive mechanism 256 includes a handle 258 supported for rotation on the vehicle door 54 (not shown in FIGS. 20 and 21). The handle 258 engages a drive shaft 260 which, in turn, engages a plastic drive pulley 262. As shown in FIG. 21, the first pinion gear 178 includes a plastic driven pulley 264 integrally formed therewith and positioned immediately adjacent the support bracket 224. The drive pulley 262 and driven pulley 264 are joined together through a drive cable 266 which includes a series of nubs 268 which engage with recessed dimples 270 (shown in FIG. 21) on both the drive and driven pulleys 262,264. Specifically, the drive cable 266 comprises a bendable, stretch-resistant wire including a series of beads 268 spaced closely together on the wire. The preferred embodiment of the drive cable 266 is sold by W M Berg Inc. of Lynbrook N.Y. and comprises a continuous cable of stainless steel or aramid fiber which is covered with polyurethane. At controlled intervals, the polyurethane coating is also molded into the beads 268 on the cable. Although the beads 268 are shown along the entire length of the cable in FIGS. 20 and 21, the beads 268 need only be located along the portions of the drive cable 266 that will be in engagement with the drive and driven pulleys 262,264. The cable 266 has many advantages over a standard chain and sprocket drive including the fact that lubrication is not necessary, the cable 266 is very quiet to operate, and the cable 266 resists slippage within the dimples 270 in the drive and driven pulleys 262,264. However, various alternative drive cables could be utilized including a standard chain or belt in engagement with sprockets on the drive and driven pulleys.

The drive cable 266 forms a continuous loop and is engaged with three plastic guide pulleys 272,274,276 which control the path of the drive cable 266. Unlike the drive and driven pulleys 262,264, the guide pulleys 272,274,276 do not include dimples for receiving the beads 268 on the drive cable 266. The first guide pulley 272 is positioned slightly below the drive pulley 262 and between the drive pulley 262 and the first rack 170. The second guide pulley 274 is positioned adjacent a top end 278 of the first rack 170, and the third guide pulley 276 is positioned adjacent a bottom end 280 of the first rack 170. The first guide pulley 272 is mounted to a distal end of a tension-adjust arm 282 (shown in FIG. 20) which is pivotally mounted to the door 54 (not shown in FIG. 20) or other stationary structure. A screw 284 or other device allows the tension-adjust arm to be secured in a desired position. After the cable 266 is installed on the guide pulleys 272,274,276 and on the drive and driven pulleys 262,264, the tension-adjust arm 282 is moved until the proper tension is reached in the drive cable 266 and then the tension-adjust arm 282 is secured in position.

Beginning at the drive pulley 262, the path of the drive cable 266 goes from the top of the drive pulley 262 to the bottom of the first guide pulley 272, then upwardly to the second guide pulley 274, then over the second guide pulley 274 and down to the driven pulley 264, then around the driven pulley 264 to the third guide pulley 276, and then finally up to and around the drive pulley 262. The locations of the first and third guide pulleys 272,276 serve to maintain the drive cable 266 in engagement with a majority of the circumference of the drive pulley 262, as shown in FIGS. 20 and 21.

A guide bracket 286 is mounted on the support bracket 224 immediately adjacent the first pinion gear 178. The guide bracket 286 includes a semi-circular recess 288 which surrounds approximately one-half of the outer circumference of the driven pulley 264. The majority of the recess 288 in the guide bracket 286 is closely spaced from the driven pulley 264. However, the recess 288 flares outwardly away from the driven pulley 264 adjacent top and bottom edges of the guide bracket 286. In this manner, as the drive cable 266 enters the region between the guide bracket 286 and the driven pulley 264, the drive cable 266 is gradually brought into engagement with the driven pulley 264.

Rotation of the handle 258 will result in rotation of the drive shaft 260 and, consequently, the drive pulley 262. The engagement of the drive cable 266 with the drive pulley 262 will cause the drive cable 266 to rotate in a direction corresponding to the direction of rotation of the drive pulley 262. This movement of the drive cable 266 will also result in corresponding rotation of the driven pulley 264, causing the first pinion gear 178 to rotate and causing vertical motion of the support bracket 224 and, ultimately, the window 52. Said another way, the drive cable 266 transfers rotational torque from the drive pulley 262 to the driven pulley 264 and, ultimately, to the first pinion gear 178.

Figure 22:
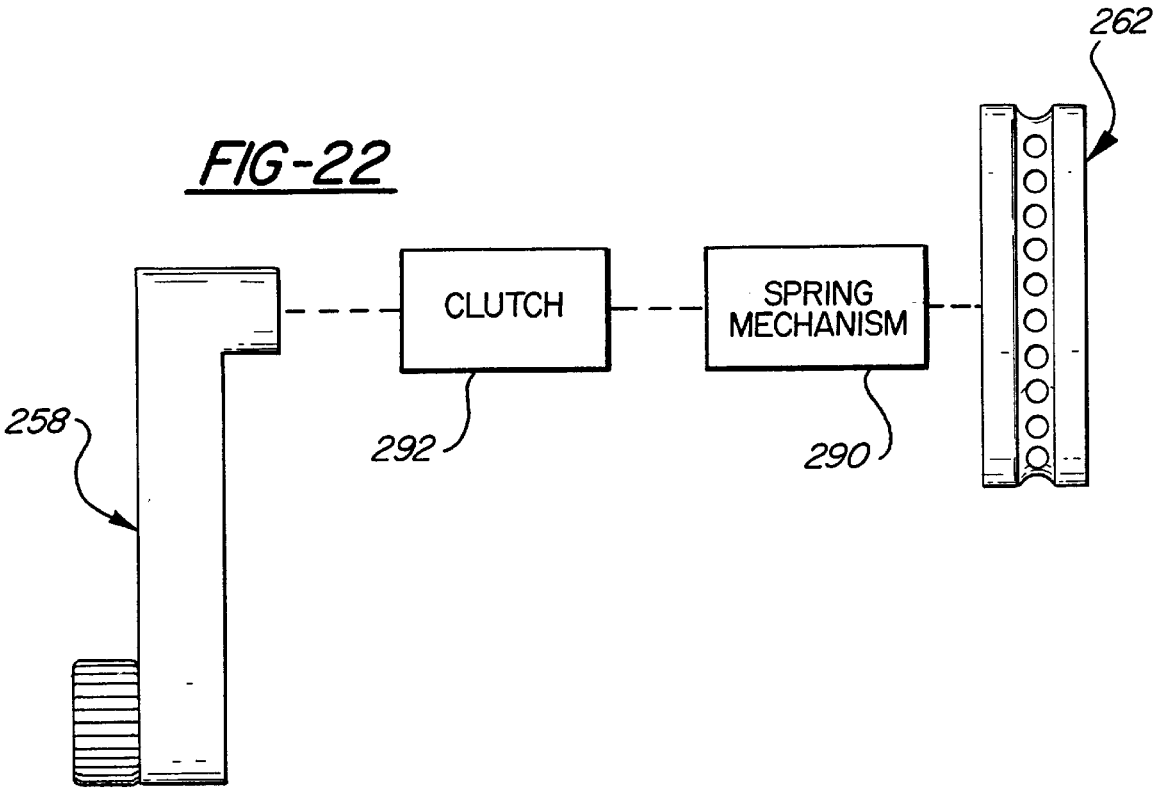
FIG. 22 is a schematic view of a clutch and spring mechanism for the handle of the third embodiment.

The weight of the window 52 will give the window 52 a natural tendency to move downward. In order to keep the window 52 in a desired location, the handle 258 includes a spring mechanism 290 shown schematically in FIG. 22 which is operatively engaged with the drive pulley 262. The spring mechanism counteracts the weight of the window and provides an initial bias against rotation of the handle 258 in a direction corresponding to downward motion of the window 52. The biasing force provided by the spring mechanism 290 is sufficient to counteract the weight of the window 52 and can be easily overcome by a person rotating the handle 258. The spring mechanism 290 is a common, prior art device found in manual-drive window lift systems as would be understood by those skilled in the art.

The handle 258 also includes a clutch 292 for preventing the handle 258 from applying excessive torque to the drive cable 266. The clutch 292 is shown schematically in FIG. 22 and operates like a standard hand-held torque wrench in which only a maximum torque can be applied before slippage will occur between the handle 258 and the drive pulley 262. Thus, when the window 52 has reached a fully raised, closed position, a user will be able to apply only limited torque to the handle 258 and, consequently, to the drive pulley 262 before the clutch 292 will disengage, thereby preventing damage to the drive cable 266 caused by excessive torque.

Two primary design concerns in a window lift system are to minimize the noise during operation of the assembly and to minimize the overall weight of the assembly. One way to reduce noise is to minimize the RPMs required by the motor 64 during operation. This is accomplished in the present invention by selecting appropriate sizes for the pinion gear 62 and driven gear 122. Reduction of the motor RPMs also reduces the shock placed on the system when the window 52 reaches a fully open or fully closed position. To reduce the weight of the assembly, the present invention is designed to minimize the torque required from the motor 64 and, hence, the required size of the motor 64.

Selecting the proper sizes for the pinion gear 62 and driven gear 122 is a complex process because the sizes must be selected to obtain the proper balance of low RPMs, sufficient horsepower required from the motor 64, low shock on the pinion gear teeth 130, and low weight of the system. Reducing the size of the driven gear 122 is one way to improve the gear ratio between the worm gear 120 and the driven gear 122 and, hence, reduce the RPMs required from the motor 64. The horsepower required from the motor 64 is directly proportional to the required RPMs and torque such that the Horsepower (HP)=(Torque*RPM)/a constant. Thus, improving the gear ratio reduces the RPMs and, hence, the required horsepower. Reducing the driven gear 122 size will also necessarily reduce the weight of the system.

The shock observed by the driven gear 122 during stoppage is a product of the torque multiplied by the motor RPMs. For a given window system, this value must always be a constant and is directly proportional to the motor speed. To minimize failure due to shock, the shock on the gear teeth should be kept to a minimum and the worm gear speed should also be minimized. To optimize the material usage and minimize motor speed, noise, and shock, the driven gear 122 should be as small as possible, with a practical lower limit of 1 inch in diameter, and the pinion gear 62 should be approximately equal to or larger than the driven gear 122.

Increasing the size of the pinion gear 62 will require fewer revolutions for the same distance of travel relative to the rack 56, resulting in a reduced pinion gear speed. Because the pinion gear 62 and driven gear 122 are joined by the central shaft 124, a reduction in the pinion gear speed will cause a corresponding reduction in both the driven gear speed and, hence, motor speed with a consequential reduction in noise and shock. On the other hand, decreasing the size of the pinion gear 62 results in reduced torque and load at the expense of increased motor speed.

Experimentation has demonstrated that a direct drive rack and pinion system, as in the present invention, is four to five times more efficient in terms of torque requirements and weighs less than half a conventional scissor-type system. This efficiency may be further enhanced by utilizing stored energy from the clock springs 132. In essence, the clock spring 132 stores the gravitational potential energy lost by the window 52 as the window 52 is moved downward and later releases this stored energy to assist upward motion during the upstroke. As such, the motor 64 is required to supply less energy while maintaining control of the speed of operation.

For example, for a window having a closure distance of 20 inches and a desired closure time of 4 seconds, prior art systems have approximately utilized a 2 inch diameter driven gear, a 60:1 gear ratio between the worm gear and the driven gear, and a 0.75 inch diameter pinion gear. This results in a pinion and driven gear free speed of 127.5 RPM, a worm gear (and motor) RPM of 7650, and a generally noisy system. By contrast, the present invention typically utilizes a 1 inch diameter driven gear, a 30:1 gear ratio between the worm gear and the driven gear, and a 1 inch diameter pinion gear.

This results in a pinion and driven gear RPM of approximately 87.5 and a worm gear (and motor) RPM of approximately 2625.

A further increase in the size of the pinion gear 62 will yield an additional reduction in the RPM requirements of the motor 64 and worm gear 120. However, as the diameter of the pinion gear 62 increases, the torque required from the motor 64 also increases due to increased torque required at the interface between the rack 56 and pinion gear 62. With the clock spring 132 of the present invention in the pinion gear 62, supplemental torque is provided on the upstroke of the window, reducing the required torque output from the motor 64 and, hence, the size of the motor 64.

For example, the system with a clock spring could include a 1 inch diameter driven gear, a 30:1 gear ratio between the worm gear and the driven gear, and a 3 inch diameter pinion gear. This would result in a pinion gear and driven gear RPM of 32 and a motor and worm gear RPM of 900. It is expected that a 40 to 45 inch-pound torque motor could be used in a system with a clock spring as compared to a 60 inch-pound torque motor in a system without a clock spring. Both embodiments are a significant improvement over present day systems in which a 125 inch-pound torque motor is required. An additional advantage of the present invention is that, due to the reduced shock on the driven gear, that the need for an integral shock absorber within the driven gear is eliminated. In this way the driven gear and pinion gear may be injection molded as one piece, further simplifying the system and subsequent assembly. The following is a table summarizing the comparative gear sizes and RPM requirements for the examples discussed above.

TABLE 1

| | Relative Torque | Armature Speed RPM | Gear Size (Ins) | Gear Ratio | Pinion Size (Ins) | Pinion Speed (RPM) | Driven Gear (RPM) | COMMENT |
|---|---|---|---|---|---|---|---|---|
| A | 12.5 | 7650 | 2[a] | 60 | 0.75 | 127.5 | 127.5 | Prior art rack and pinion |
| B | 36.6 | 2625 | 1[b] | 30 | 1.0 | 87.5 | 87.5 | Present invention without clock spring |
| C | 100. | 900 | 1[b] | 30 | 3.0 | 32.0 | 32.0 | Present invention with clock spring |

[a]Calculated parameters for closing a window in 4 seconds using vertical Rack and Pinion Systems.
[b]Closure distance is 20 inches, Closure time is 4 seconds.

In terms of the gear sizes and gear ratios, several preferred arrangements have been derived. In a first system without a clock spring 132 and including a single rack 56 and a separate guide track 58, a driven gear 122 having a diameter between 0.75 and 1.5 inches is provided and a driven gear 122 to pinion gear 62 diameter ratio of between 2:1 and 1:4 is provided. In a similar system with a clock spring 132, a driven gear 122 to pinion gear 62 diameter ratio of between 1:4 and 1:2 is provided.

In another system without a clock spring 132 and with two separate racks 150,152 with meshing pinion gears 158,160 driven by a double ended motor 164, a driven gear with a diameter between 0.75 and 1.5 inches is provided and a driven gear to pinion gear 158,160 ratio between 2:1 and 1:4 is provided. In a similar system with a clock spring 132 in each pinion gear 158,160, a driven gear to pinion gear 158,160 ratio between 1:4 and 1:2 is provided.

The total weight of the first embodiment of the window lift assembly including the rack 56, support bracket 61, guide track 58, slide 60, motor 64, and pinion gear 62 is expected to be in the range of 2.5 to 3.5 pounds. This results in a significant weight reduction over prior art rack and pinion systems. In particular, a 50% to 60% weight reduction is provided over the prior art "scissor" type systems.

In operation, it generally takes longer for the window 52 to be raised than lowered because the motor 64 must work against the weight of the window 52, motor 64, and other components supported by the window 52. However, it is desirable to design a window lift system in which it takes an equal amount of time for the window 52 to be raised and lowered. In a system with a clock spring 132, the spring 132 may be selected and pre-loaded so that the spring 132 decreases the upstroke time to be equal to the downstroke time. The spring 132 can be preset so that its medium energy delivered in the upstroke would be equal to one-half the sum of the force required to push the window 52 up into a sealed position plus the force required to drive the window 52 down. These are all readily measurable forces for any particular window system. In lieu of the clock spring 132, the upstroke and downstroke times may be matched by placing a suitable resistor (not shown) in series with the motor 64 when the window 52 is in the downstroke to provide an additional electrical load to slow the downstroke speed of the motor 64.

During operation, the torque at the interface between the rack 56 and pinion gear 62 places a moment on the window 52. The moment is applied at the bottom edge of the window 52 at the support bracket 61 and places a twisting force on the window 52 which increases the friction between the window 52 and the guide slots 86,88, requiring more torque from the motor 64 to move the window 52. The magnitude of the moment depends both on the amount of torque as well as the spacing between the center of gravity of the window 84 and the rack 56. Ideally, the inside edge 148 of the motor 64 should be aligned with the window 52 and the rack 56 should be as close as possible to the inner surface 80 of the window 52 such that the distance L2, as shown in FIG. 8, will be reduced by half a motor width compared to systems in which the motor 64 is centered below the window 52. Preferably, the distance L2 is one-quarter inch or less to achieve maximum benefit from the present invention. This arrangement of the rack 56 and motor 64 relative to the window 52 will reduce the angular moment on the window 52 and, hence, the required torque from the motor 64. Experimentation with the closure assembly 10 of the present invention has established that there is considerably less tendency for the window bracket and motor 64 to "pull-in" as represented by the arrow labeled P in FIG. 8.

The weight of the motor 64 also creates a moment on the window 52 if the center of gravity of the motor 64 is spaced from the window 52. Although prior systems have eliminated this problem by aligning the center of gravity of the motor 64 beneath the window 52, such an arrangement effectively prevents the rack 56 from being positioned immediately adjacent the window 52. More specifically, as shown in FIG. 8, the pinion gear 62 is spaced from the motor 64 a fixed distance depending upon the length of the central shaft 124 joining the driven gear 122 and the pinion gear 62. In the present invention, the pinion gear 62 is placed immediately adjacent the window by positioning the motor 64 on the opposite side of the window 52 as the pinion gear 62. In this manner, the center of gravity of the motor 64 can be maintained close to the center of gravity 84 of the window 52 to reduce the moment caused by the weight of the motor 64 while still preserving the benefit of having the rack 56 and pinion gear 62 immediately adjacent the window 52.

Figure 1:
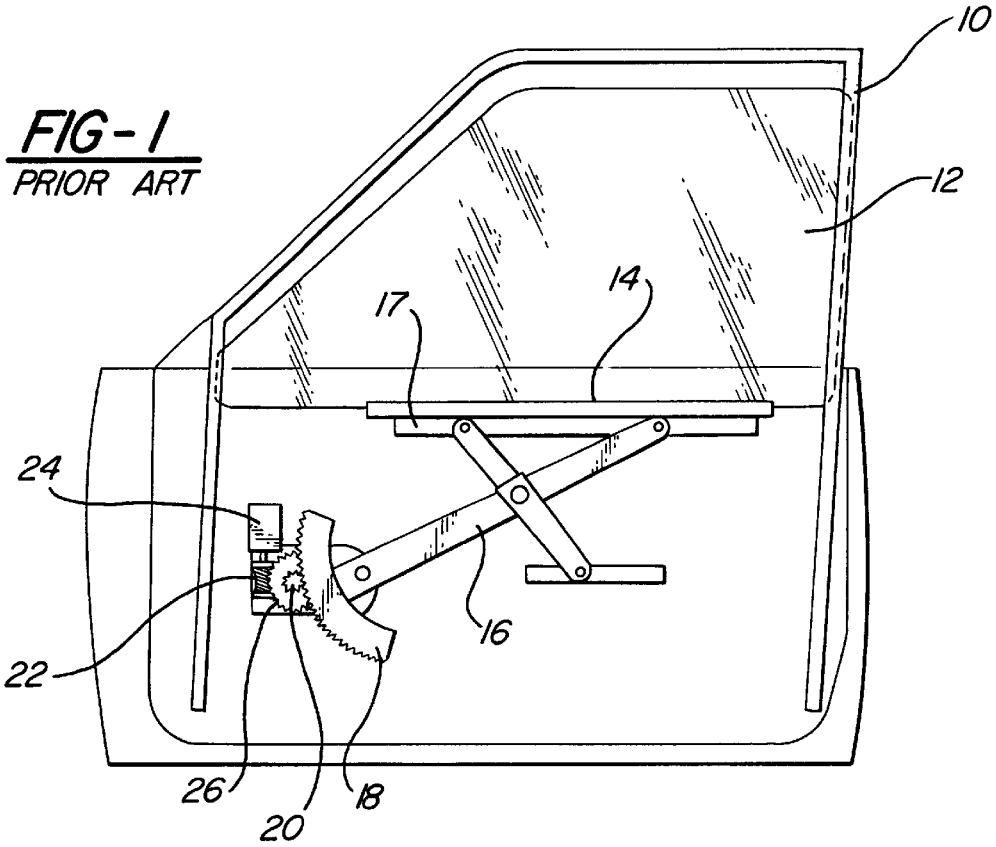
FIG-1 PRIOR ART
FIG. 1 is a perspective view of a prior art scissor-type window lift assembly.
Figure 2:
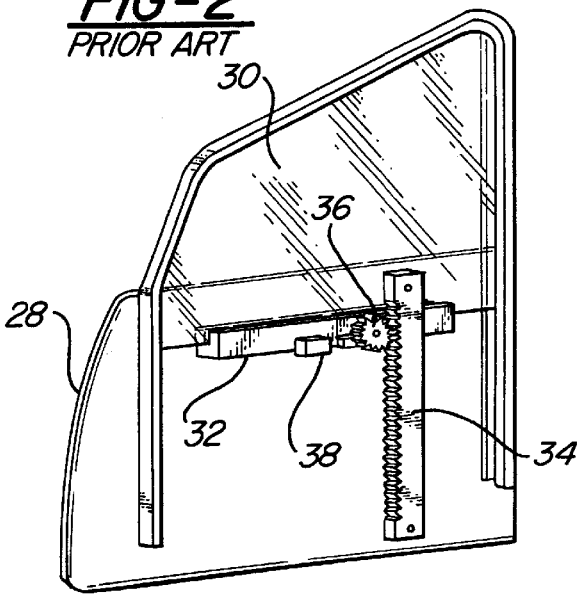
FIG-2 PRIOR ART
FIG. 2 is a perspective view of a first prior art rack-and-pinion window lift assembly.
Figure 3:
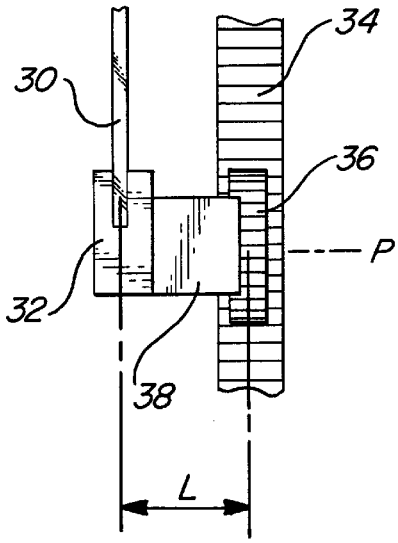
FIG-3 PRIOR ART
FIG. 3 is a cross sectional view of a first prior art rack-and-pinion window lift assembly.
Figure 4:
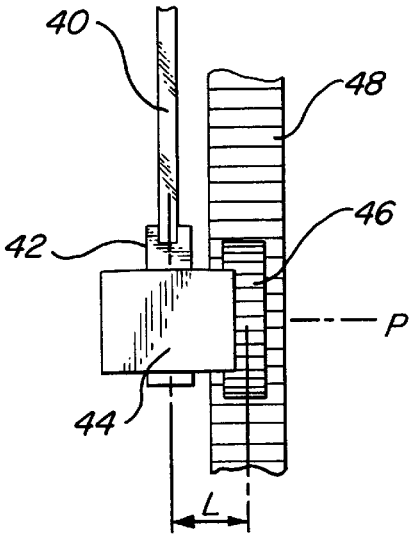
FIG. 4 is a cross sectional view of a second prior art rack-and-pinion window lift assembly.
Figure 5:
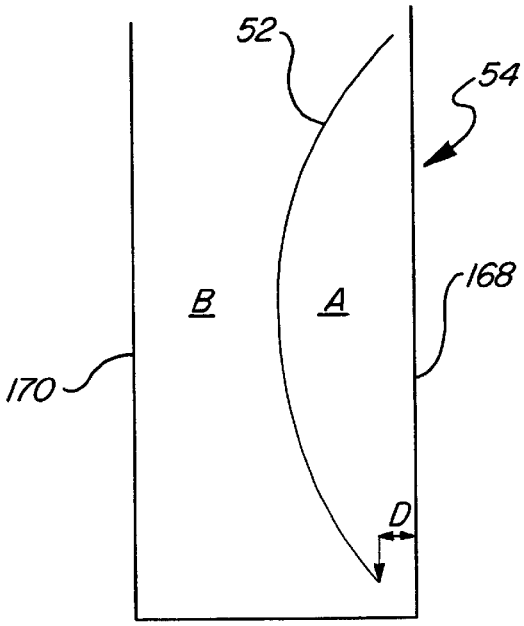
FIG. 5 is a schematic cross sectional view of a vehicle door including a window.

FIG. 5 illustrates another advantage of the present invention over the prior art. FIG. 5 is a cross-sectional view of a door 54 including an inside surface 168, an outside surface 170, and a window 52. The window 52 divides the space within the door 54 into regions labeled A and B. To minimize the thickness of the door 54, the distance D between the window 52 and inside surface 168 of the door 54 should be minimized. In the prior art, either the entire drive mechanism was placed in region A or the rack plus a half of the motor width was placed in region A, making distance D larger than necessary. In the present invention, the distance D is minimized by placing the rack 56 immediately adjacent the inner surface 80 of the window 52 and by positioning the motor 64 on the outside surface 82 of the window 52.

Although the present invention minimizes the torque placed on the window 52 as discussed above, the torque that remains will create a displacement force tending to displace the window 52 in a direction perpendicular to the inner surface 80 of the window 52. In prior art systems, the rack and pinion are prevented from relative movement in a direction perpendicular to the inner surface of the window. Without freedom of movement in this direction, the displacement force will significantly increase the friction between the rack and pinion and, hence, increase the required torque from the motor. The displacement force can also cause jamming and binding between the rack and pinion if no relative movement is permitted. In the present invention, the rack 56 is designed to permit relative movement between the gear teeth 94 on the rack 56 and the gear teeth 130 on the pinion gear 62 by eliminating any structure at opposing ends of the rack teeth 94 which would interfere with movement of the pinion gear teeth 130. Alternatively, this could be accomplished by reducing the relative width of the pinion gear teeth 130 with respect to the rack teeth 94 to permit relative movement therebetween. As shown in FIG. 9, the guide track 58 and slide 60 are also designed to allow movement in the thickness direction of the door 54 (perpendicular to the inner and outer surfaces 80,82 of the window 52) while restricting movement in the breadthwise direction (toward the side edges 70,72 of the window 52).

As can be seen from FIG. 6, the first side edge 70 of the window 52 is longer than the second side edge 72. This difference in length can also cause a performance problem in window-lift systems. Specifically, as the side edges 70,72 travel in the guide slots 86,88, the increased length of the first side edge 70 will result in greater friction between the first side edge 70 and the first guide slot 86 than between the second side edge 72 and guide slot 88. During the upstroke of the window 52, the window 52 will tend to take the path of least resistance by pulling away from the first guide slot 86, causing the window 52 to pivot toward the second guide slot 88. If the side edges 70,72 of the window 52 were of equal length, pivoting would be effectively precluded but, unfortunately, the shorter second edge 72 of the window 52 provides a pivot point" for the window 52. In prior art systems with a rigid rack, binding can occur between the rack and pinion due to the inability of the rack to compensate for any side-to-side motion of the pinion gear caused by pivoting motion of the window. The flexible rack 56 of the present invention eliminates this problem by permitting movement of the rack 56 in a direction perpendicular to the rack 56 and parallel to the window 52.

The invention has been described in illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A closure assembly comprising:

a closure member;

a first pinion gear supported by said closure member;

a first rack operatively engaged with said first pinion gear;

a second pinion gear supported by said closure member;

a second rack parallel to said first rack and spaced from said first rack;

said second rack being operatively engaged with said second pinion gear;

said first pinion gear being operatively engaged with said second pinion gear; and further comprising a pair of spacer gears disposed between said first and said second pinion gears and operatively engaged therewith wherein said pair of spacer gears transfers rotational torque from said first pinion gear to said second pinion gear.

2. An improved closure assembly comprising:

a closure member;

a first pinion gear supported by said closure member;

a first rack operatively engaged with said first pinion gear;

a drive pulley;

a driven pulley directly engaged with said first pinion gear; and a drive cable operatively engaged with said drive pulley and said driven pulley whereby said drive cable will transfer rotational torque from said drive pulley to said driven pulley.

3. The closure assembly of claim 2 further comprising:

a guide track non-integral with said first rack and spaced from said first rack;

said guide track being parallel to said first rack; and a slide supported by said closure member and operatively engaged with said guide track.

4. The closure assembly of claim 2 wherein said first pinion gear comprises:

an axle;

an outer hub including a plurality of gear teeth circumferentially disposed thereabout; and a clock spring included a first end joined to said axle and a second end joined to said outer hub.

5. The closure assembly of claim 2 further comprising:

a handle assembly operatively engaged with said drive pulley;

said handle assembly including a clutch to prevent excessive torque from being transferred from said handle assembly to said drive pulley;

said handle assembly including a spring mechanism operatively engaged with said drive pulley to provide a limited bias against rotation of said handle assembly.

6. The closure assembly of claim 2 further comprising:

a support bracket;

said driven pulley being supported on said support bracket; and a guide bracket supported on said support bracket adjacent said driven pulley wherein said drive cable extends between said guide bracket and said driven pulley and is maintained in engagement with said driven pulley by said guide bracket.

7. The closure assembly of claim 2 further comprising at least one guide pulley in engagement with said drive cable.

8. The closure assembly of claim 2 wherein:

said drive cable is flexible and includes a length;

said drive cable includes a series of closely-spaced nubs along at least a portion of said length thereof; and said drive pulley and said driven pulley each include recesses adapted to engage said nubs on said drive cable.

9. The closure assembly of claim 2 wherein said first rack is flexible.

10. The closure assembly of claim 2 further comprising:

a second pinion gear supported by said closure member; and a second rack operatively engaged with said second pinion gear.

11. The closure assembly of claim 10 wherein said first pinion gear is separated from said second pinion gear.

12. The closure assembly of claim 11 wherein said first pinion gear comprises:

an axle;

an outer hub including a plurality of gear teeth circumferentially disposed thereabout; and a clock spring included a first end joined to said axle and a second end joined to said outer hub.

13. The closure assembly of claim 2 wherein said second pinion gear comprises:

an axle;

an outer hub including a plurality of gear teeth circumferentially disposed thereabout; and a clock spring including a first end joined to said axle and a second end joined to said outer hub.

14. The closure assembly of claim 10 wherein said first pinion gear is operatively engaged with said second pinion gear.

15. The closure assembly of claim 14 wherein said first pinion gear comprises:

an axle;

an outer hub including a plurality of gear teeth circumferentially disposed thereabout; and a clock spring included a first end joined to said axle and a second end joined to said outer hub.

16. The closure assembly of claim 15 wherein said second pinion gear comprises:

an axle;

an outer hub including a plurality of gear teeth circumferentially disposed thereabout; and a clock spring including a first end joined to said axle and a second end joined to said outer hub.

17. The closure assembly of claim 10 wherein said second rack is flexible.

18. The closure assembly of claim 10 wherein:

said closure member includes a support bracket;

said support bracket includes a first guide member disposed immediately adjacent said first rack on opposing side of said first rack from said first pinion gear; and said support bracket includes a second guide member disposed immediately adjacent said second rack on opposing side of said second rack from said second pinion gear.

19. A closure assembly comprising:

a closure member;

a support bracket joined to an edge of said closure member;

a frame;

drive means supported by said support bracket and engaged with said frame for moving said closure member relative to said frame; and at least one mounting foot joining said closure member to said support bracket, said at least one mounting foot being capable of lateral movement with respect to said support bracket whereby said closure member is capable of lateral movement with respect to said support bracket.

20. A closure assembly comprising:

a closure member;

a first pinion gear supported by said closure member;

a first rack operatively engaged with said first pinion gear;

said closure member including a support bracket;

said support bracket including a first guide member disposed immediately adjacent said first rack on an opposing side of said first rack from said first pinion gear; and said first guide member being supported for rotation on said support bracket.

21. The closure assembly of claim 20 further comprising:

a second pinion gear supported by said closure member;

a second rack parallel to said first rack and spaced from said first rack;

said second rack being operatively engaged with said second pinion gear;

said support bracket including a second guide member disposed immediately adjacent said second rack on an opposing side of said second rack from said second pinion gear; and said second guide member being supported for rotation on said support bracket.

* * * * *

UNITED STATES PATENT AND TRADEMARK OFFICE

CERTIFICATE OF CORRECTION

PATENT NO. : 6,389,753 B1
DATED : May 21, 2002
INVENTOR(S) : Paul J. Fenelon

It is certified that error appears in the above-identified patent and that said Letters Patent is hereby corrected as shown below:

Column 6,
Line 27, “as” should be -- is --;

Column 8,
Line 62, “pinions” should be -- pinion --;

Column 10,
Line 32, “200,220” should be -- 220,222 --;

Column 11,
Line 27, “perpendiculary” should be -- perpendicularly --;

Column 15,
Lines 11-29, the following 2 paragraphs under “Table 1” of the specification are shown under “a” and “b” under the Table in the patent and should be shown as 2 paragraphs under the title Table 1:

“Calculated parameters for closing a window in 4 seconds using vertical Rack and Pinion Systems”;

“Closure distance is 20 inches, Closure time is 4 seconds”;

The “a” and “b” shown under the Table in the patent should be deleted and should read:

-- (a) A 2 in. driven gear is a practical lower size limit when an integral shock mechanism is required.

(b) A 1 in. driven gear is a practical lower size limit for the application --;

Column 17,
Line 54, before “pivot” insert -- " --;

Column 18,
Line 23, delete “An improved” and insert -- A -- therefor;
Line 47, “included” should be -- including --;

UNITED STATES PATENT AND TRADEMARK OFFICE

CERTIFICATE OF CORRECTION

PATENT NO. : 6,389,753 B1
DATED : May 21, 2002
INVENTOR(S) : Paul J. Fenelon

It is certified that error appears in the above-identified patent and that said Letters Patent is hereby corrected as shown below:

Column 19,
Lines 26 and 44, "included" should be -- including --;
Line 28, "2" should be -- 12 --.

Signed and Sealed this

Fifteenth Day of April, 2003

JAMES E. ROGAN
*Director of the United States Patent and Trademark Office*